US005716294A

United States Patent [19]

Childers et al.

[11] Patent Number: 5,716,294

[45] Date of Patent: Feb. 10, 1998

[54] BREAKAWAY BASKETBALL RIM ASSEMBLY

[75] Inventors: Ronald P. Childers, Marysville; Scott A. Lawver, Everett; Kenneth L. Hehr, Ferndale, all of Wash.

[73] Assignee: Basketball Products International, Inc., Everett, Wash.

[21] Appl. No.: 564,937

[22] Filed: Nov. 30, 1995

[51] Int. Cl.[6] ..... A63B 63/08

[52] U.S. Cl. ..... 473/486

[58] Field of Search ..... 473/486; 248/548, 248/549, 573, 574, 583, 900

[56] References Cited

U.S. PATENT DOCUMENTS

| | | | |
|---|---|---|---|
| 3,188,913 | 6/1965 | O'Shei | 248/900 X |
| 3,193,230 | 7/1965 | Crankshaw | 248/583 |
| 4,111,420 | 9/1978 | Tyner . | |
| 4,194,734 | 3/1980 | Tyner . | |
| 4,365,802 | 12/1982 | Ehrat . | |
| 4,433,839 | 2/1984 | Simonseth . | |
| 4,534,556 | 8/1985 | Estlund et al. . | |
| 4,738,448 | 4/1988 | Liester . | |

FOREIGN PATENT DOCUMENTS

| | | | |
|---|---|---|---|
| 854885 | 11/1960 | United Kingdom | 248/900 |
| 900208 | 7/1962 | United Kingdom | 248/900 |

*Primary Examiner*—Paul E. Shapiro

*Attorney, Agent, or Firm*—Zarley, McKee, Thomte, Voorhees, & Sease

[57] ABSTRACT

A breakaway basketball rim assembly in which there is a release assembly which operably interconnects the base member and the rim member, the release assembly being configured to release the rim member in response to a downward load which is received at any point along an extended frontal arc of the circular hoop, so that the hoop tilts downwardly generally in the direction of the load. There is also a reaction load mechanism for returning the hoop to its horizontal playing position. In a preferred embodiment, a U-shaped fulcrum joint extends between the reaction load in the hoop so as to provide a pivot point in line between the reaction load and any impact point along the extended frontal arc of the hoop. The joint is configured so that the rim releases in response to a substantially identical impact load anywhere along the frontal arc.

20 Claims, 13 Drawing Sheets

BREAKAWAY BASKETBALL RIM ASSEMBLY

FIELD OF THE INVENTION

The present invention relates to basketball rim assemblies, and, in particular to such assemblies which are designed to alleviate excessive loads which are applied to the rim.

BACKGROUND

One of the problem areas in modern day basketball is the abuse to which a basketball rim and backboard may be subjected when a player executes a "dunk" shot. In some instances, when the player has completed the dunk shot and is falling toward the ground, the player will grab the rim to retain his balance or possibly break the fall. Also, it sometimes happens that the player will subject the rim to impact loads in the execution in the dump shot by slamming his arms downwardly against the rim as he is thrusting the ball through the hoop.

Unless otherwise alleviated, the forces exerted on the rim by the various executions of the dunk shot can cause the rim to deform, or more seriously, cause the glass backboard to shatter. In either case, the problem is both expensive to correct and causes unacceptable delay of the game. For this reason, various release devices have been adopted in recent years which permit the rim to "break away" from the backboard, rather than receiving the full brunt of the impact forces. Typically, these systems have taken the approach of mounting the rim to the backboard by means of a spring mount that urges the rim towards its horizontal playing position: When a downward force is exerted on the rim sufficient to overcome the forces of the spring, the spring allows the rim to deflect downwardly. Then, when the downward force is released (e.g., by the player releasing the rim from his grip), the spring returns the rim to its playing position. The mechanism may also be provided with means for dampening the return motion.

A number of "breakaway" rims which employ this basic principle are known in the prior art. Examples include those shown in the following U.S. Pat. Nos: U.S. Pat. No. 4,111,420 (Tyner '420), U.S. Pat. No. 4,194,734 (Tyner '734), U.S. Pat. No. 5,365,802 (Ehrat); U.S. Pat. NO. 4,433,839 (Simonseth); U.S. Pat. No. 4,534,556 (Estlund et al.). Although these various designs differ in some aspects (some of which will be discussed in greater detail below), they share the common characteristic that the pivoting motion which follows release of the rim is for the most part confined to a single arc of rotation, which in large part leads to the problems which have been solved by the present invention.

To illustrate this, reference is made to FIGS. 1–2, which show a "generic" breakaway rim assembly 10 of the type which is common in the prior art. As can be seen, the typical prior art assembly 10 comprises a base plate 14 and a releasable rim member 16. The base plate is a flat, generally rectangular metallic piece which is fixedly secured to the backboard 12 by means of bolts 18 at the corners of the baseplate. Extending a short distance forwardly from the upper edge of the baseplate is a short overhanging flange 20. The rim member 16 comprises a circular hoop 22 and a mounting bracket 24 that supports the hoop. This bracket 24 comprises a horizontal flange 26 which is fixedly connected to the rearward edge of the hoop 22, and a vertical flange 28 which extends downwardly from the rearward edge of the horizontal flange. A pair of support arms 30 are connected to side portions of the hoop, and extend downwardly to the lower part of the vertical flange 28.

The lower edge portion of the mounting bracket 24 is pivotally mounted to the baseplate 14 by a hinge mechanism 32. In the particular arrangement which is shown, the hinge mechanism comprises a mounting arm 34 which is welded to the vertical flange 28 and has a pair of rearwardly extending ears 36 which receive hinge pin 38. Pin 38, in turn, is received in a sleeve 40 which is welded to the baseplate 14.

The release mechanism is generally designated 42 and comprises a releasable bayonet mechanism 44 and the shock-absorbing spring mechanism 46. As can be seen more clearly in FIG. 2, the shock absorbing spring mechanism comprises a stud member 48 around which is mounted a coil spring 50. The rearward end of the stud member extends through a bore in the vertical flange 28 and is mounted to a horizontally extending bolt 52 which permits a limited up and down swinging movement of the stud member. The forward end of the study member is provided with a retaining head 54. The coil spring 50 is retained between this head and the vertical flange 28 so as to urge the rim 16 towards its normal, horizontal position.

In normal play, the rim assembly 10 is in the position which is shown in FIG. 1. Then, when a downward force of sufficient magnitude is exerted on the hoop 22, the bayonet mechanism 44 releases and the hoop pivots downwardly around the axis provided by pivot pin 38, toward the position shown in FIG. 2. As this is done, the coil spring 50 is compressed between the retaining head 54 and flange 28, so when the hoop 22 is subsequently released from the downward force, the spring causes the rim to return to its horizontal plane position, as indicated by arrow 55.

While, as has been noted above, breakaway rim mechanisms of this general type have proven to be effective in reducing the impact loads on the rim assembly, the hinge mechanism 32 gives rise to certain deficiencies in use. Firstly, because the rim assembly is able to pivot downwardly only in a single arc, about the horizontally extending axis which is provided by pivot pin 38, the system is incapable of absorbing torsional loads, which are then transmitted directly to the backboard mounts. For example, an off-center downward force received at one of the lateral edges of the hoop, as indicated by arrow 56, causes torque loads which are transmitted to the backboard 12 via the mounting ears 34 at the ends of the pivot pin and bolts 18, in the direction indicated by arrow 58. These rotational loads, applied at the mounting bolt holes, can be sufficient to cause the heavy glass backboard to shatter during play.

A second deficiency, in addition to and compounding the torsional problem described above, is that the amount of downward force required to cause release of the rim mechanism varies from point to point along the circular hoop. For example, a downward force $F_1$ applied at point 60 along the forwardmost edge of the circular hoop will have the mechanical advantage which is offered by the relatively long lever arm between this point and the pivot pin 38, to effect release of the bayonet mechanism 44 and compression of the coil spring 50. However, for an impact received along the side edge of the hoop, for example at offset point 62, the effective length of the lever arm is much shorter. As a result, a much greater downward force $F_2$ is required to effect the same motion of the release/pivot mechanism. In other words, an impact on a side edge of the hoop requires a much greater downward force before the rim will release than an impact at its forwardmost edge. As a result, not only do the side edge impacts result in greater—and possibly excessive—loading in the frontal plane, but their increased magnitude also aggravates the torsional effect described above.

In addition to damage to the backboard and mounts, another result of this combination of factors is that prior art breakaway rims have been unable to provide entirely satisfactory performance for use in professional play. For example, the resistance of the rim before it breaks away, i.e., its "stiffness" (which is typically measured at the forward edge of the hoop), must be of a certain minimum value to meet NBA standards; if the rim is sufficiently "stiff", however, excessively high loads and possible backboard breakage may result from side impacts. On the other hand, if the mechanism is made sufficiently "soft" to avoid the excess loading problem, then the rim will become excessively "spongy", absorbing too much energy when it is struck by a basketball during the ordinary course of play.

Although some prior designs have been configured to permit a limited degree of side-to-side motion (e.g., see the Ehrat and Tyner '734 patents), these have provided only a rudimentary, limited response to side impacts, and have not addressed the root causes of the problems noted above. For example, the Tyner '734 patent shows a mounting plate having a slot 79 which permits a limited amount of deflection to the right or left, in addition to frontal plane pivoting about pin 22'. The design uses a friction structure (nut 67 and washer 68) to provide a predetermined amount of preload in the side deflection mechanism, however no provision is made for establishing a constant release force for an impact received anywhere along the circular hoop, and, furthermore, the apparatus employs a complicated spring/hydraulic shock absorber mechanism.

The Ehrat design, in turn, employs a ball and socket mechanism 27 located well below the plane of the hoop to permit a small degree of side-to-side motion; again, there is no equalization of the release force at various points along the rim, and also the bottom socket mechanism and its mounting bracket are flimsy and unstable, and subject to damage by vertical forces resulting from downward impacts.

Accordingly, there exists a need for a "breakaway" basketball rim which will release in response to an impact at any point along the front or side portions of the hoop, and which will obviate the possibility of excessive torsional loads being transmitted to the backboard. Moreover, there exists a need for such a rim mechanism which will release in response to an equal downward impact force, and no matter where this is applied along the front and side portion of the hoop. Still further, there exists a need for such a rim which provides a very stable hoop for proper action when it is struck by a basketball, and which is sturdy and exhibits good wear characteristics so as to enjoy a long Service life.

SUMMARY OF THE INVENTION

The present invention has solved the problems cited above. Broadly, this is a breakaway basketball rim assembly which comprises (a) a stationary base member for mounting to a vertically extending backboard; (b) a releasable rim member having a circular hoop portion which extends in a generally horizontal plane; and (c) a release assembly which operably interconnects the base member and the rim member, the release assembly comprising (i) means for releasing the rim member in response to a downward load received at any point along an extended frontal arc of the circular hoop portion thereof, so that the hoop portion tilts downwardly from the horizontal plane generally in the direction of the point at which the load is received, so as to avoid transmission of significant Shock and torsional loads to the backboard, and (ii) means for returning the circular hoop portion of the rim member to the generally horizontal plane following a release of the downward load from the hoop portion.

The means for releasing the rim member may comprise pivot means for permitting the rim member to pivot downwardly relative to the stationary base member in the direction towards the point along the frontal arc at which the downward load is received, and the means for returning the hoop portion of the rim member to the horizontal plane may comprise resilient reaction load means connected to the rim member and the stationary base member so that the reaction load means yieldingly biases the rim member towards an initial plane position in which the hoop portion extends in the generally horizontal plane. The pivot means may comprise a pivot structure for providing a pivot point between the rim member and the stationary base member substantially in direct alignment between the point along the frontal arc at which the downward load is received and reaction point at which the reaction load means acts upon the rim member to return the hoop portion to the horizontal plane.

The extended frontal arc of the circular hoop portion may be an approximately 180° frontal arc, and the pivot structure may comprise fulcrum means having an elongate, substantially semi-circular forward portion disposed intermediate the reaction point and the hoop portion, and having a curvature which generally corresponds to that of the 180° frontal arc of the hoop portion, so that the semicircular portion of the fulcrum means provides a fulcrum point which is located between the downward load and the reaction load for any point along the 180° frontal arc of the hoop portion. The fulcrum means may comprise an elongate bead member having a protruding, generally semi-circularly rounded edge along the forward portion of the fulcrum means, and an elongate channel member having a generally semi-circularly dished groove along the forward portion of the fulcrum means, the bead member being received in the groove of the channel member when the rim member is in the initial playing position so as to form a fulcrum joint which extends in a generally horizontal plane.

The pivot structure may further comprise a generally horizontal lower pivot plate portion of the stationary base member, the lower pivot plate portion having the channel member formed in an upper surface thereof, and an upper pivot plate portion of the rim member which extends rearwardly from and generally parallel to the hoop portion, the upper pivot plate portion having the bead member formed on a lower surface thereof, so that the upper and lower pivot plate portions extend generally parallel to one another in face-to-face juxtaposition when the rim member is in the initial playing position. The resilient reaction load means, in turn, may comprise means for yieldingly biasing the upper and lower pivot plate portions towards one another into the parallel, face-to-face juxtaposition. The reaction load means may comprise compression spring means mounted to portions of the upper and lower pivot plate portions rearwardly of the curved forward portion of the fulcrum joint, so that the compression spring means is compressed as the pivot plate portions rearwardly of the fulcrum joint move apart as the rim member tilts downwardly in the direction of the point at which the downward load is received by the hoop portion. In a preferred embodiment, the reaction load means comprises a shaft member having an upper end which is retained in the upper pivot plate portion and a lower end which extends through a bore in the lower pivot plate portion, a coil compression spring mounted around the lower end of the shaft member below the lower plate portion, and a retainer mounted on the shaft member below the coil spring so that the spring is compressed between the retainer and lower surface of the lower pivot plate portion as the rearward portions of the pivot plate portions move apart.

In another embodiment, the fulcrum means may comprise a first pivot member having a substantially planar engagement surface, and a second pivot member having an outwardly bevelled border extending along a substantially semi-circular path around a generally planar engagement surface, intermediate the reaction point in the hoop portion; the first and second pivot members being arranged in face-to-face abutment when the rim member is in the initial playing position, so that in response to a downward load the engagement surface of the first pivot member pivots onto the bevelled border of the second pivot member so as to tilt the hoop portion of the rim member towards the point at which the downward load is received.

Preferably, the means for releasing the rim member comprises means for releasing the rim member in response to a substantially identical minimum downward load received at any point along the extended frontal arc of the hoop portion. The pivot structure may form a first lever arm from the point on the hoop portion at which the downward load is received to the pivot point, and a second lever arm from the pivot point to the reaction point, the first and second lever arms defining a ratio which is substantially identical for all points along the extended frontal arc of the hoop portion, so that the rim member is released in response to substantially identical minimum load received at any point along the frontal arc.

DETAILED DESCRIPTION a. Overview

Figure 1:
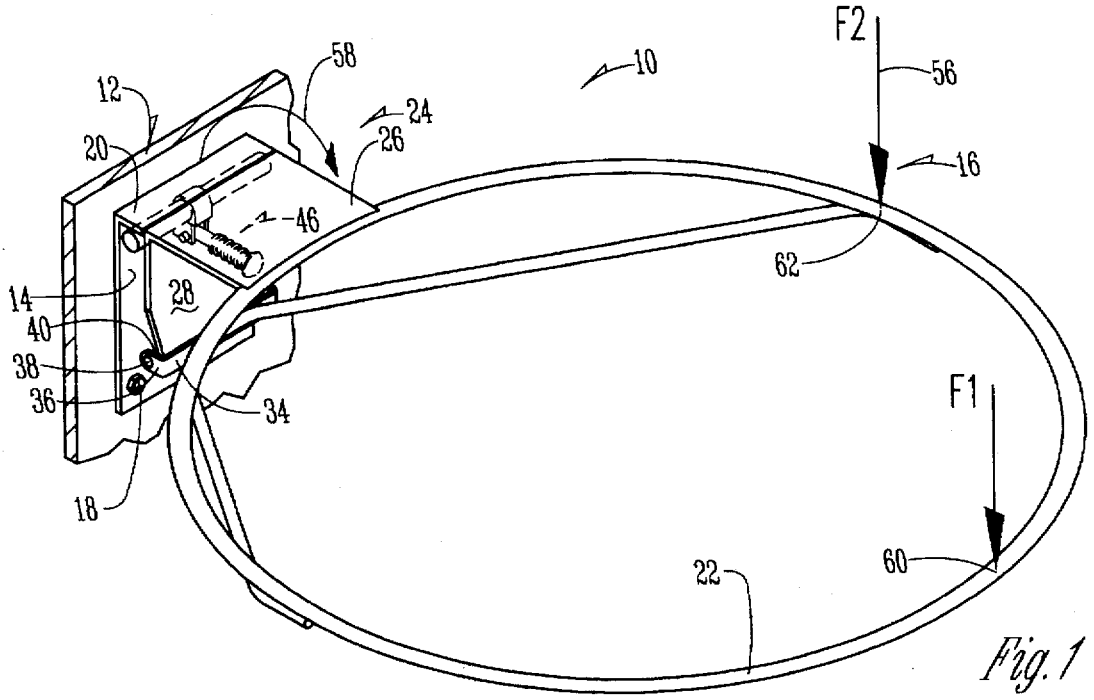
FIG. 1 is a perspective view of a prior art releasable basketball rim, illustrating the deficiencies which are exhibited thereby.
Figure 2:
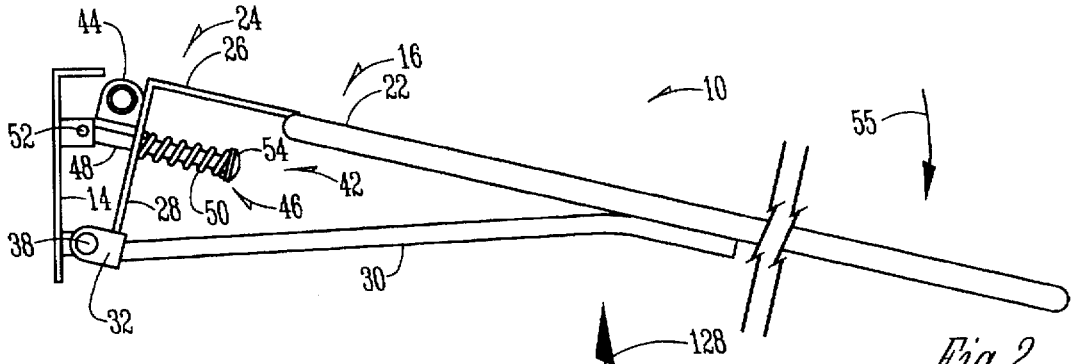
FIG. 2 is a side, elevational view of the prior art breakaway rim of FIG. 1.
Figure 3:
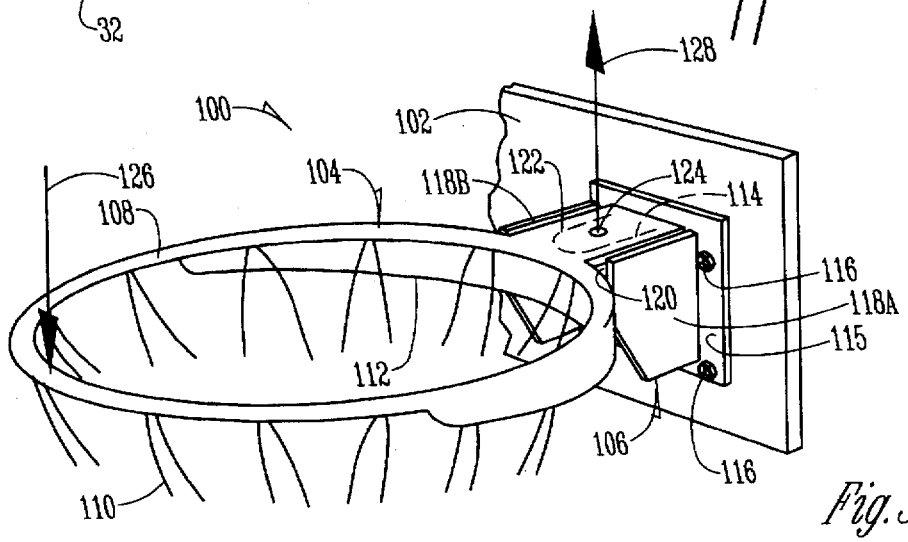
FIG. 3 is a perspective view of the breakaway basketball rim of the present invention, illustrating generally the response of this to downward impact loads at various points along the hoop portion thereof.

FIG. 3 provides a perspective view of a breakaway basketball rim assembly 100 in accordance with the present invention, mounted to a backboard 102. As can be seen, the rim assembly 100 comprises two major subassemblies, namely the more-or-less horizontally extending rim unit 104 and the mounting unit 106.

The rim unit 104 comprises a circular, regulation-size hoop member 108 which supports the net 110. Along its sides and towards its rearward end, the hoop member is provided with a downwardly extending stiffening flange 112, and a horizontally extending upper pivot plate 114 projects from the rearward edge of the hoop member perpendicularly toward the backboard 102. The mounting unit 106, in turn, comprises a baseplate 115, which is mounted to the backboard 102 by corner bolts 116. A pair of vertically and outwardly extending bracket plates 118*a*, 118*b* are welded to the baseplate, and support a horizontally extending lower pivot plate 120, which is not clearly visible in FIG. 3, but which is shown in greater detail in FIGS. 5–10.

As will be described in greater detail below, the mounting unit 106 represents the stationary portion of the assembly, while the rim unit 104 is free to pivot relative thereto in response to downward impact on the hoop portion, the interface between the two units being at the upper and lower pivot plates 114, 120. In particular, the pivot interface comprises an elongate, U-shaped fulcrum track, as indicated generally by dotted line image 122, and a reaction load connection 124. Thus, the hoop member 108 and extension plate 114 essentially form a lever arm, with the pivot point being provided by the fulcrum track 122; a downward force exerted on the hoop, as in the direction indicated by arrow 126, causes the reaction load attachment point 124 to move upwardly, in the direction indicated by arrow 128, with spring force operating to subsequently return the rim assembly to the horizontal playing position which is shown in FIG. 3.

Figure 4:
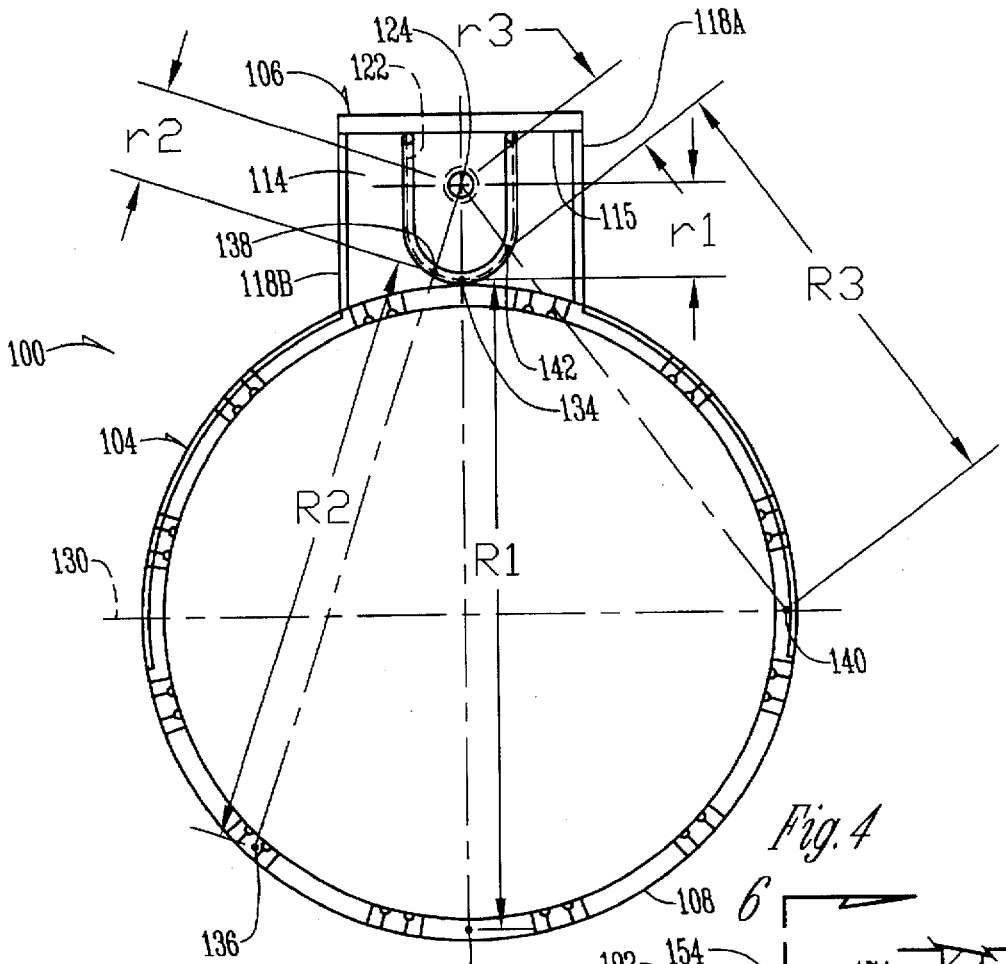
FIG. 4 is a plan, partly schematic view of the breakaway rim assembly of FIG. 3, showing the configuration of the pivot/spring mechanism thereof relative to impact loads which are received at various points along the circular hoop.

The significance of the U-shaped fulcrum track can be explained more clearly with reference to FIG. 4. As can be seen, the forward end of the joint is semi-circular in the horizontal plane, and mirrors the semi-circular shape of the hoop portion of the rim which is forward of an axis 130 which defines the 180° frontal arc of the rim. As a result, no matter where a downward impact load is received along the frontal arc of the hoop 108, the joint 122 provides a fulcrum point which is positioned in line between the impact load and the reaction force at the spring-loaded attachment 124.

Consequently, the rim unit is able to pivot downwardly along an arc lying in a plane which is directly aligned with the impact load, no matter where this develops along the frontal arc of the hoop. Moreover, as can be seen in FIG. 4, the forward end of the U-shaped fulcrum track is preferable configured so that the ratio of the two lever arms making up each "lever" is substantially constant. For example, for a downward impact load received at the forwardmost point 132 of the hoop 108, the first lever arm $R_1$ extends along the centerline of the assembly to the pivot point 134, and the second lever arm $r_1$ extends from the pivot point to the reaction load point 124, with the ratio "$R_1$:$r_1$" is expressed as a value "k". For an impact received at a point 136 approximately midway between the front and side of the hoop, the first lever arm $R_2$ extends from the load point to a second fulcrum point 138, which is displaced a spaced distance along the U-shaped fulcrum track from the centerline pivot point 134, and the second lever arm $r_2$ extends from the fulcrum point 138 to the reaction load point 124, it will be observed that, because of the position of the impact point 136, lever arm $R_2$ is shorter than the first arm $R_1$; however, because of the U-shaped configuration of the fulcrum track, the second lever arm $r_2$ is also shorter than the corresponding arm $r_1$, so that the ratio "$R_2$:$r_2$" yields substantially the same constant value "k". Similarly, for an impact received at a point 140 along the 180° axis 130, the ratio of the lever arms $R_3$ and $r_3$ from fulcrum point 142 yields substantially the same constant value "k". Since the resistance force which is provided by the return spring at 124 remains constant, the fact that the ratio of the lever arms are all substantially the same means that the rim will "break away" in response to a substantially identical downward impact load, no matter where this is received along the 180° frontal arc of the hoop. In the particular embodiment which is illustrated, the ratio "R:r" is approximately equal to 5.7:1, but it will be understood that this ratio may be selected as a matter of design choice based on spring rate, anticipated impact loads, mounting structure limitations, minimum breakaway force, and so forth.

Although it is preferable that the breakaway mechanism be configured to release in the direction of a downward load applied anywhere along at least the 180° frontal arc of the rim, it will be understood that the apparatus of the present invention may be configured to release in a direction towards any point along an extended arc which is significantly greater or less than 180°, up to substantially 360° around the perimeter of the rim. Having provided an overview of the rim assembly of the present invention, specific aspects of its structure and operation will now be described in greater detail.

b. Rivot/Spring Mechanism

Figure 5:
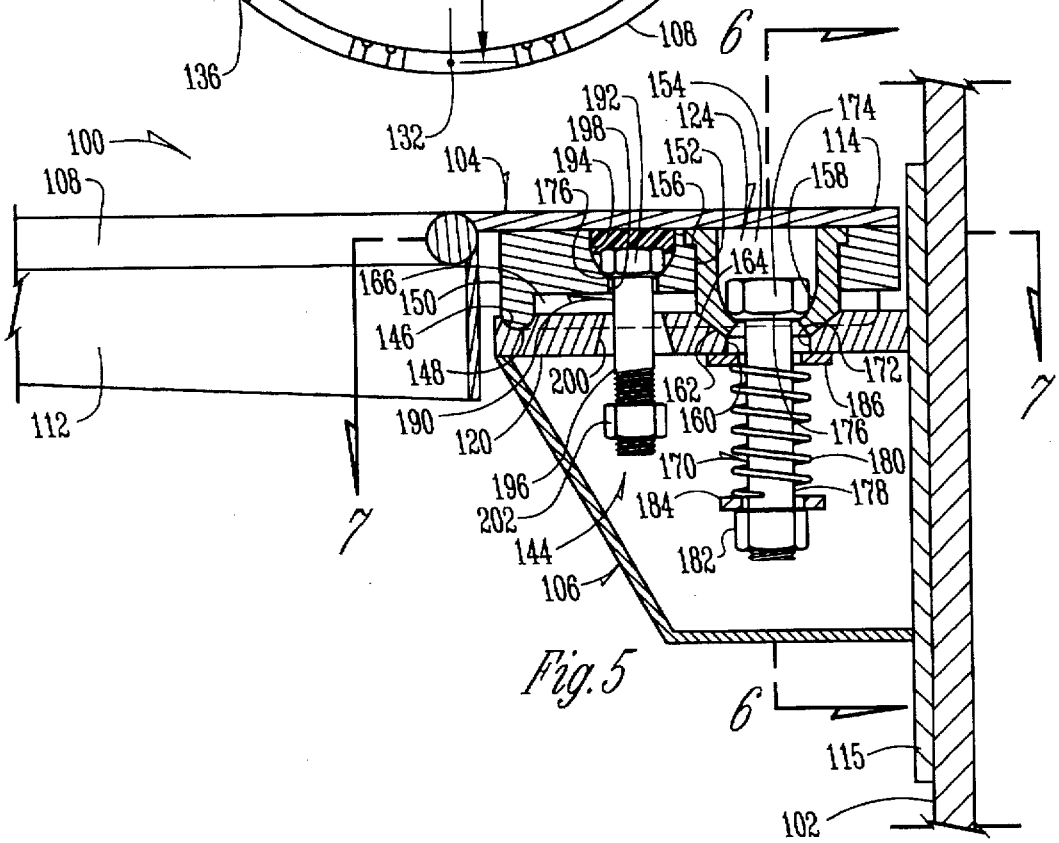
FIG. 5 is a side view of a vertical cross-section showing the pivot mechanism and return spring of the rim assembly shown in FIG. 3.

FIG. 5 is an enlarged view of the mounting units 106 and the rearward portion of the rim unit 104, showing the spring-pivot mechanism 144 in greater detail. As can be seen, the lower pivot plate 120 is welded to the baseplate and bracket plates of the mounting unit 106, and is provided with a shallow, semi-circular channel 146, which forms the lower part of the U-shaped fulcrum track. The upper part of the joint is formed by a convexly protruding, semi-circular bead 148 which matches and fits within the channel 146. The bead 148 is formed on the lower edge of a downwardly extending spacer block 150 which is mounted to the underside of the upper pivot plate 114.

A bore 152 is formed through the upper pivot plate and spacer block to provide the reaction load attachment 124. A retainer cup 154 is received in the bore and is held therein against downward movement by a cooperating annular shoulder 156. The lower end of the retainer cup is provided with a hemispherically dished bearing surface 158 which surrounds a necked down lower bore 160 having an outwardly bevelled lower edge. The retainer cup extends below the lower edge of the spacer block 150, and is provided with a tapered lower end 162 which is received in a correspondingly chamfered opening 164 in the top of the lower pivot plate 120; in combination with the U-shaped bead 146, the downwardly protruding portion of the retainer cup serves to maintain a working gap 166 between the upper and lower pivot plates 114, 120.

A spring-loaded bolt 170 extends through the bottom opening 158 of the retainer cup and through a corresponding bore 172 formed in the lower pivot plate 120. The head 174 of the bolt is sized to be retained by the lower end of the cup, and is provided with a spherically bevelled lower edge 176 which engages the dished internal bearing surface 156 of the retainer cup. The shaft 178 of the bolt extends downwardly below the lower pivot plate (between the two side bracket plates 118*a*, 118*b*) and is surrounded by a coil spring 180. A nut 182 threaded onto the lower end of the bolt compresses the coil spring between a lower washer 184 and an upper washer 186 which abuts the underside of the lower pivot plate 120. Thus, as the reaction load attachment 124 is pulled upwardly in response to a downward impact on the hoop portion of the rim, the spring is compressed between the lower pivot plate 120 and the upwardly moving washer 184, offering progressively increasing resistance to the displacement of the rim. Also, by adjusting the position of the nut 182 on the threaded lower end of the bolt, the resistance which is offered by the spring can be set to a predetermined pre-load, thereby adjusting the minimum downward load which is required to displace the rim unit from its seat.

As a safety measure, a second bolt 190 passes through the upper and lower pivot plates forwardly of the reaction load attachment point. The head 192 of this bolt is retained in a hemispherically cupped socket 194 formed in the spacer block of the upper pivot plate, and again has a hemispherically bevelled lower edge which engages the socket walls for pivoting motion therein. The shaft 196 of the bolt extends downwardly through a bore 198 in the upper pivot plate and an outwardly bevelled bore 200 in the lower pivot plate, with a retaining nut 202 being threaded onto the bottom end of the bolt a spaced distance below the lower surface of the lower pivot plate. The safety bolt 190 is thus free to pivot in and move up and down with the upper pivot plate, relative to the lower pivot plate, as necessary to accommodate the motion of the rim unit. If for some reason, however, the main spring-loaded bolt assembly 170 or its retaining cup were to fail, the safety bolt 190 (nut 202 being sized larger than bore 200) will prevent the rim unit from becoming completely detached from the mounting unit.

Figure 6:
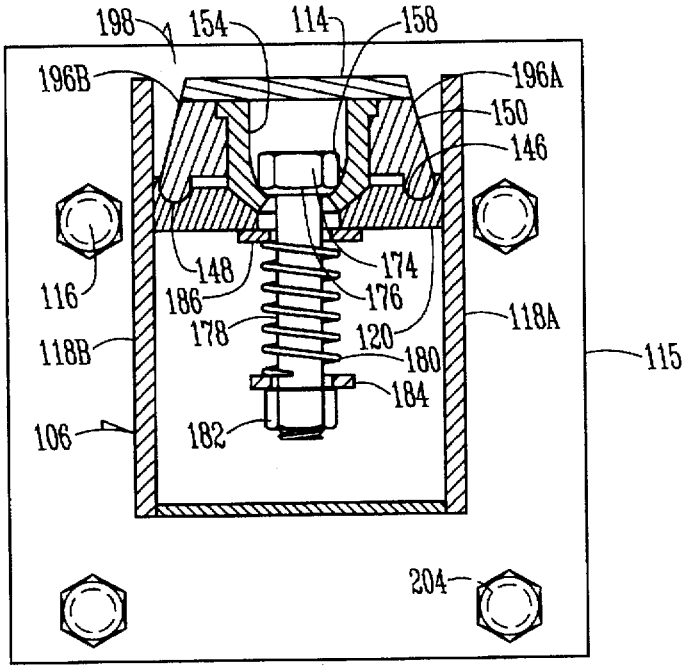
FIG. 6 is a front, end view of a cross-section taken along line 6—6 through the pivot/spring mechanism shown in FIG. 4.

FIG. 6 provides an end view of the spring-pivot assembly. As can be seen, the side faces 196*a*, 196*b* of the spacer block 150 and upper pivot plate 114 are inwardly and upwardly sloped so as to permit side-to-side rocking of the assembly in the cradle area 198 formed between the upper ends of the bracket plates 11*a*, 11*b*, as will be described in greater detail below. FIG. 6 also shows the four bores 204 which are formed in the baseplate 115 for the mounting bolts 116.

Figure 7:
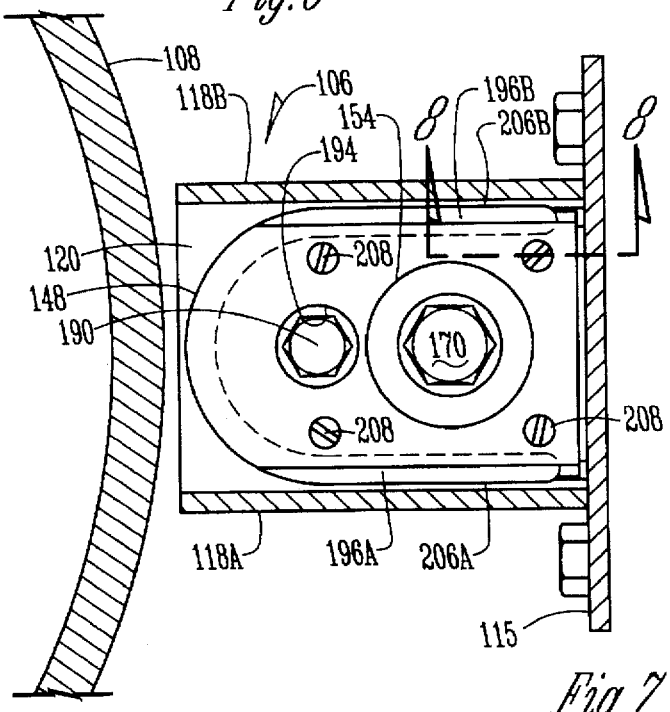
FIG. 7 is a top, plan view of the pivot/spring mechanism of FIGS. 5–6.

The U-shaped configuration of the fulcrum track can be more clearly seen in the downward looking view of FIG. 7. As was noted above, the forward end of the joint is semicircularly curved, so as to always provide a fulcrum point in line between the impact point and the reaction load, and preferably at an approximately equal lever arm ratio no matter where the impact occurs along the 180° frontal arc of the hoop 108. In some embodiments, however, it may be desirable to construct the forward end of the joint in the form of a series of short straight line segments arranged to approximate the continuous curve which is shown in FIG. 7, so as to possibly minimize manufacturing costs. The rearward end of the fulcrum track, in turn, is formed by a pair of parallel, rearwardly extending straight line segments 206*a*, 206*b*; these straight line segments provide correct alignment of the rim unit and also serve to stabilize the unit against any undesirable side-to-side motion in the horizontal plane, thus ensuring that the rim unit moves only in response to a downward impact load and not in response to side-to-side forces. The width of the bead and channel making up the fulcrum track may be selected according to the qualities in the material used and the anticipated forces involved; in the embodiment which is illustrated, in which these members are formed of hardened steel, a width of ⅜" has been found to provide sufficient strength and good wear characteristics.

Figure 8:
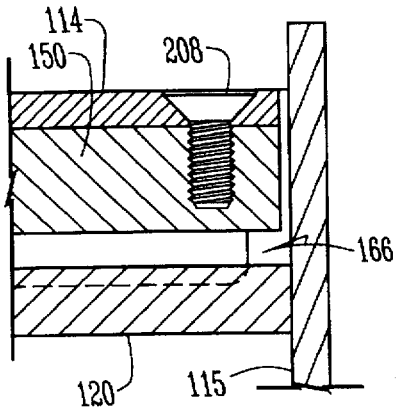
FIG. 8 is a partial, cross-sectional view, taken along line 8—8 in FIG. 7, showing one of the retaining bolts for the plate member of the pivot/spring mechanism.

FIG. 7 also shows the four screws 208 which secure the spacer block 150 to the upper pivot plate 114; as can be seen in FIG. 8, each screw 202 passes through a hole in the upper pivot plate and engages a threaded bore formed in the underlying spacer block. An advantage which is provided by this construction is that if the bead 148 of the fulcrum track (which is formed along the bottom edge of the spacer block 150) becomes damaged or worn, a new block can be installed without having to replace the entire rim unit.

c. Operation

Figure 9:
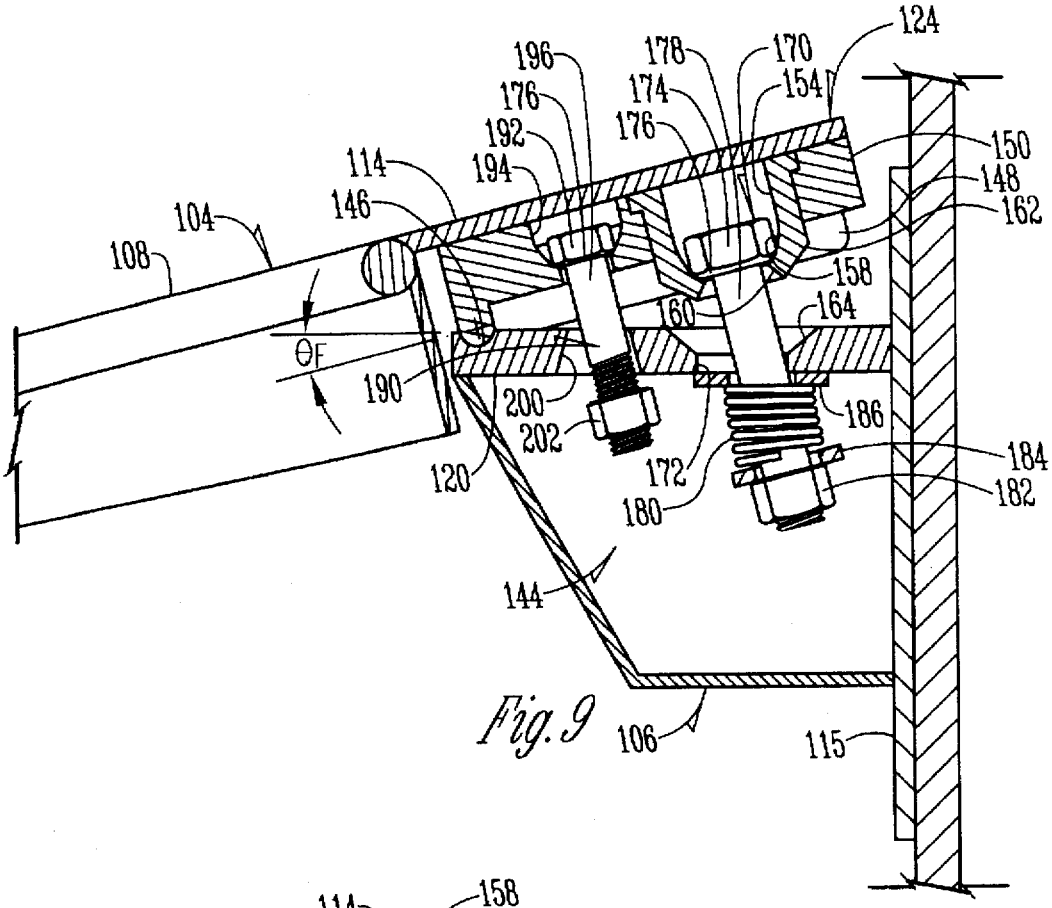
FIG. 9 is a side view similar to FIG. 5, showing the response of the pivot mechanism to a downward impact received along the forward edge of the hoop.
Figure 10:
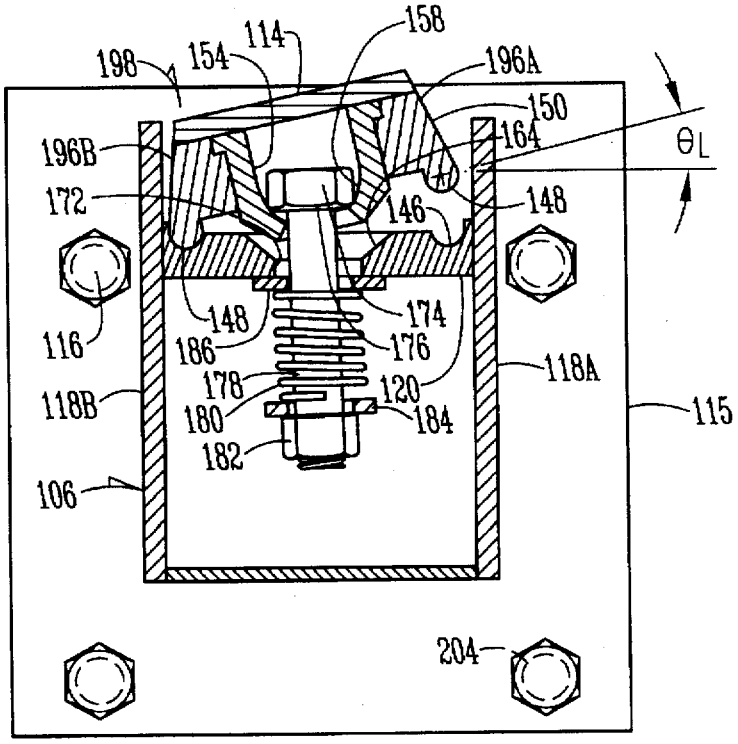
FIG. 10 is an end view of the pivot/spring mechanism, similar to FIG. 6, showing the response of the pivot/spring mechanism to a downward impact received along a side edge of the hoop.

FIGS. 9–10 illustrate the motions of the spring-pivot assembly in response to downward impact loads received by the rim unit.

FIG. 9 shows the response of the spring-pivot mechanism 144 to a downward impact load received at the front edge of the hoop, more or less on the centerline of the rim unit (e.g., at point 132 in FIG. 4). If the impact load exceeds a predetermined minimum, the rim releases and moves downwardly at its front edge, pivoting the rim unit about the fulcrum track and pulling upwardly at the reaction load attachment 124. As this is done, the spring-loaded bolt 170 is drawn upwardly, compressing the coil spring 180 between the upper and lower thrust washers 186, 184. Simultaneously, the hemispherically bevelled lower edge of the bolt head 174 pivots within the hemispherically dished lower end of the retainer cup 154 so as to accommodate the shifting angular orientation of the bolt relative to the rim unit; the outwardly bevelled bore 160 at the lower end of the retainer cup also serves to accommodate this motion. At the lower pivot plate 120, the tilting motion of the bolt is accommodated by the bevelled opening 164 and also the oversized internal diameter of the upper washer 186 and the bore 172. Similarly, the outwardly bevelled bore 200 accommodates the tilting motion of the safety bolt 190 relative to the lower pivot plate 120, and the hemispherically bevelled edge of the bolt head 192 rotates within the hemispheric socket 194 to provide additional pivoting movement.

As the rim unit moves towards its maximum angle of depression $\Theta_f$, the coil spring 180 reaches its point of maximum compression, not only limiting the range of motion of the rim unit, but also providing a relatively loft "limit stop" which enhances unit durability. Upon release of the load from the rim unit, the coil spring 180 serves to return the unit to its initial, horizontal orientation, and as this is done, the bevelled lower edge 162 of the retainer cup reacts with the champhered opening 164 to help center the unit and align the upper and lower elements of the U-shaped fulcrum track.

The motions of the assembly are similar in response to the lateral-edge impact load, as is shown in FIG. 10. As can be seen, the spring-pivot assembly tilts toward the side of the impact, as indicated by angle $\Theta_l$. As this is done, the portion of the U-shaped bead 148 on the side opposite the impact lifts out of the channel 146. Also, as was noted above, the inwardly and upwardly sloped bevel surfaces 196*a*, 196*b* provide sufficient clearance between the spacer block/upper pivot plate and the side bracket plates 118*a*, 119*b* to accommodate this motion. At the same time, the cradle area 198 which is defined by the upwardly projecting edges of the two bracket plates obviates any possibility of the upper unit becoming dislodged due to side-to-side motions.

It should be noted that, in the embodiment of the present invention which is shown in FIGS. 3–10 as well as in the other embodiments which are disclosed herein, the tilting motion of the rim unit towards the direction of the downward load is preferably resisted by a yielding, but increasing, force, e.g., the force of the compression spring 180. This permits the rim unit to tilt freely towards any point along the frontal arc and also provides a yielding stop to the range of motion of the rim unit, for improved "feel" in use and an enhanced service life.

d. Positive Latch Mechanism

Figure 11:
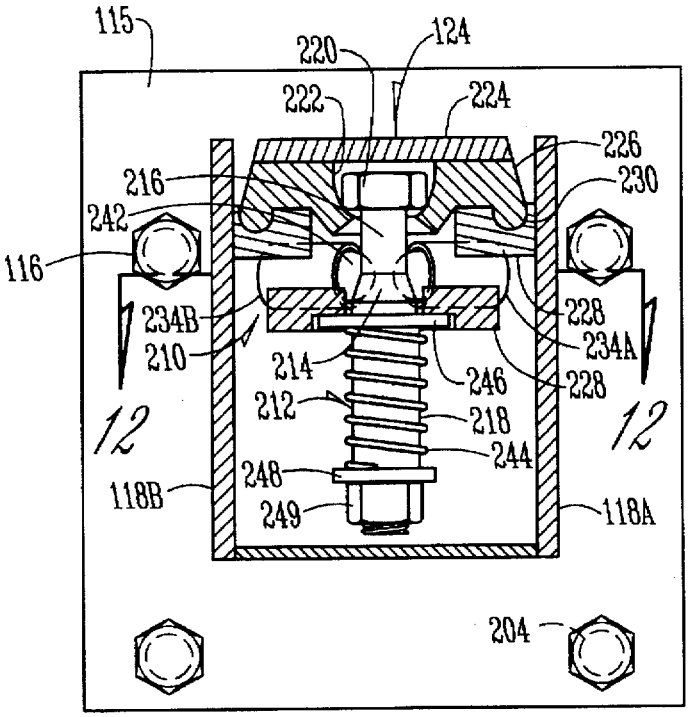
FIG. 11 is an end view of a cross-section taken through the pivot/spring mechanism of a rim assembly in accordance with a second embodiment of the present invention, in which there is a spring loaded centering mechanism for stabilizing the hoop in its horizontal, playing position.
Figure 12:
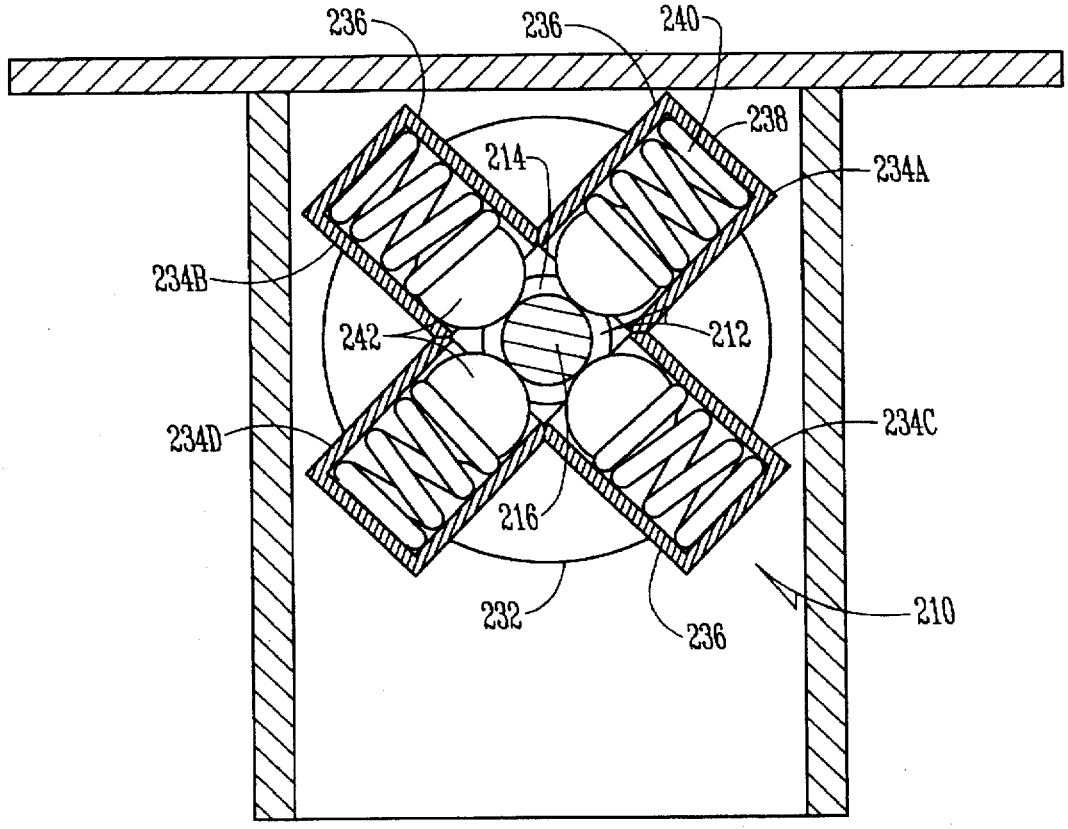
FIG. 12 is a top view of a cross-section taken along line 12—12 in FIG. 11, showing the four spring-loaded ball units which make up the centering mechanism of the rim assembly.

FIGS. 11–12 illustrate an embodiment of the present invention which is generally similar in overall configuration to that which has been described above with reference to FIGS. 3–10, except that the spring-pivot mechanism is provided with an annular latch mechanism 210 which provides positive positioning of the rim unit in the initial, horizontal position until a predetermined minimum downward force is received by the hoop. As can be seen, the spring-loaded bolt 212 in this embodiment is provided with an annular, upwardly tapered shoulder portion 214 which joins a relatively smaller diameter upper section 216 to a relatively larger diameter lower section 218. Similar to the embodiment which has been described above, the head 220 of the bolt is received in a hemispherically dished receptacle 222 which is formed in the upper pivot plate 224 and spacer block 226, which rest on the lower pivot plate 228 and are joined thereto along a U-shaped fulcrum track 230.

In the embodiment which is shown in FIG 11, however, there is a secondary support plate 232 which is mounted so that it extends parallel to and beneath the lower pivot plate at a spaced distance therefrom. Mounted between the lower pivot plate and the secondary support are several spring-loaded ball plunger units 234 (four units in the embodiment which is illustrated). As can be seen in FIG. 12, the ball plunger units 234 each comprise a cylindrical housing 236 which is closed at one end by a plug 238 and encloses a coil spring 240 which forcefully biases the ball unit 242 outwardly from the opposite end.

As can be seen in further reference to FIG. 12, the ball plunger units **234*a*–234*d* are arranged radially about the shaft of the spring-loaded bolt 212, similar to a ball bearing arrangement. Referring again to FIG. 11, it can be seen that when the rim unit is in the initial, horizontal position, the ball plunger units are in approximate axial alignment with the upper edge of the annular taper which joins the upper and lower segments of the bolt shaft. As a result, the upward movement of the reaction load attachment point 124 draws the tapered section of the bolt upwardly past the ball members 242 of the plunger units, forcing the latter outwardly in the directions indicated by the arrows in FIG. 11**. The rolling engagement between the ball units and the shaft of the spring-loaded bolt ensures a smooth action as the ball units ride over the taper and onto the large-diameter section of the bolt. At the same time, the pronounced downward slope of the tapered section acting against the compression springs in the plunger units tends to very firmly bias the rim unit toward its horizontal orientation, until sufficient downward force is received to cause the taper to ride upwardly past the plunger units.

Once past the lower end of the taper, the compression of the coil spring 244 between the upper and lower thrust washers 246 takes over, in essentially the same manner as described above; in the embodiment which is illustrated in FIG. 11, however, the configuration of the compression spring unit is slightly revised, with the upper thrust washer 246 bearing against the underside of the secondary support 232 and the lower washer being held in place by a nut 249 which is threaded onto the large diameter end of the bolt shaft. Also, inasmuch as the ball plunger units are able to depress individually so as to accommodate motion of the spring-loaded bolt, the bore in the lower support plate 232 and washer 246 through which the bolt passes is simply formed with a sufficient oversize to accommodate any shift in the angular orientation of the bolt with up and down movement of the assembly.

Figure 14:
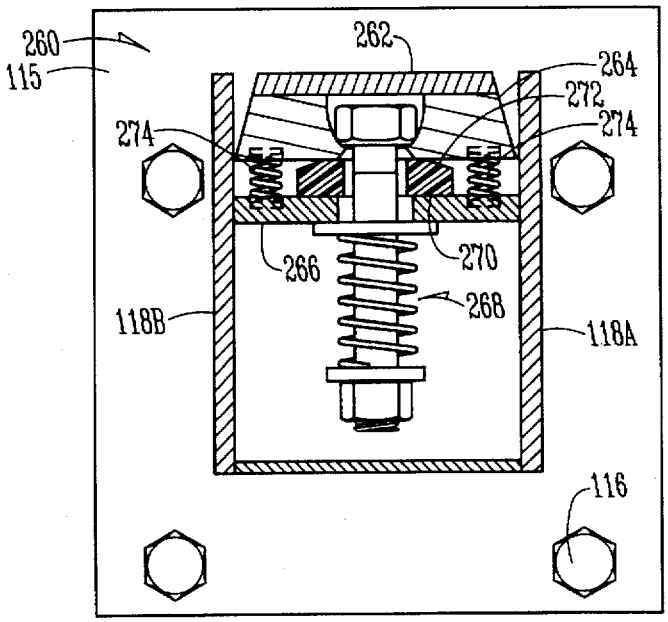
FIG. 14 is an end view similar to FIG. 6, showing the pivot/spring mechanism of an embodiment of the present invention in which the continuous pivot is provided by a plate member having a bevelled outer edge, in place of the channel configuration which is shown in FIGS. 5–10.
Figure 15:
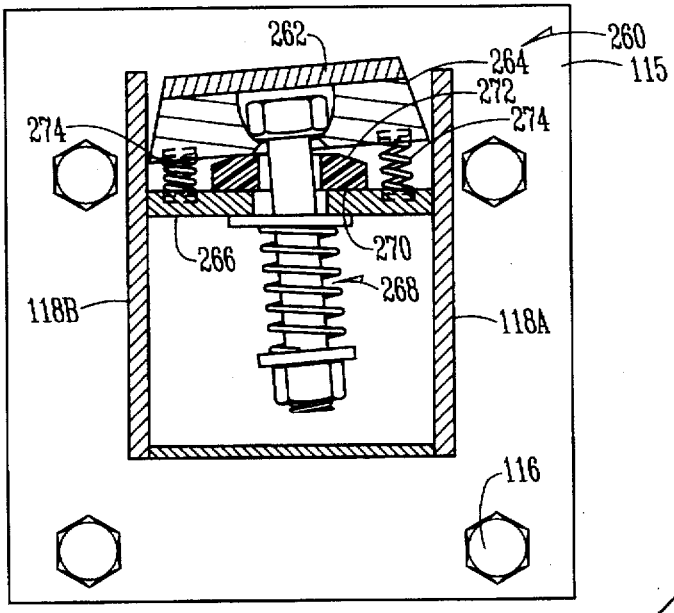
FIG. 15 is an end view similar to FIG. 14, showing the response of the pivot/spring mechanism to a downward impact received along a side of the hoop portion.
Figure 13:
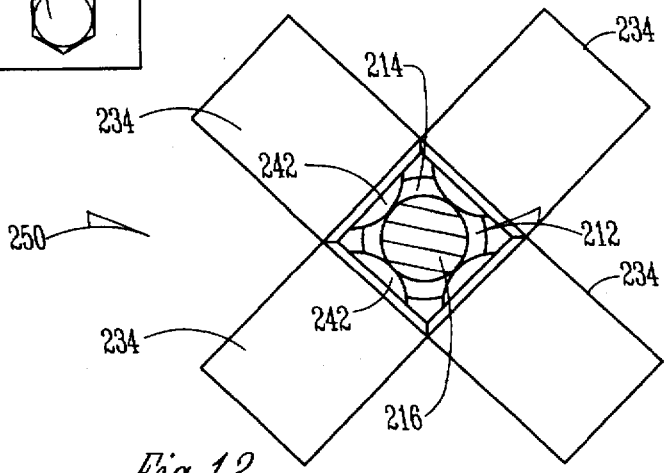
FIG. 13 is a top view of a centering mechanism similar to that shown in FIGS. 11–12, but having three spring-loaded ball units arranged about the reaction bolt instead of four.
Figure 16:
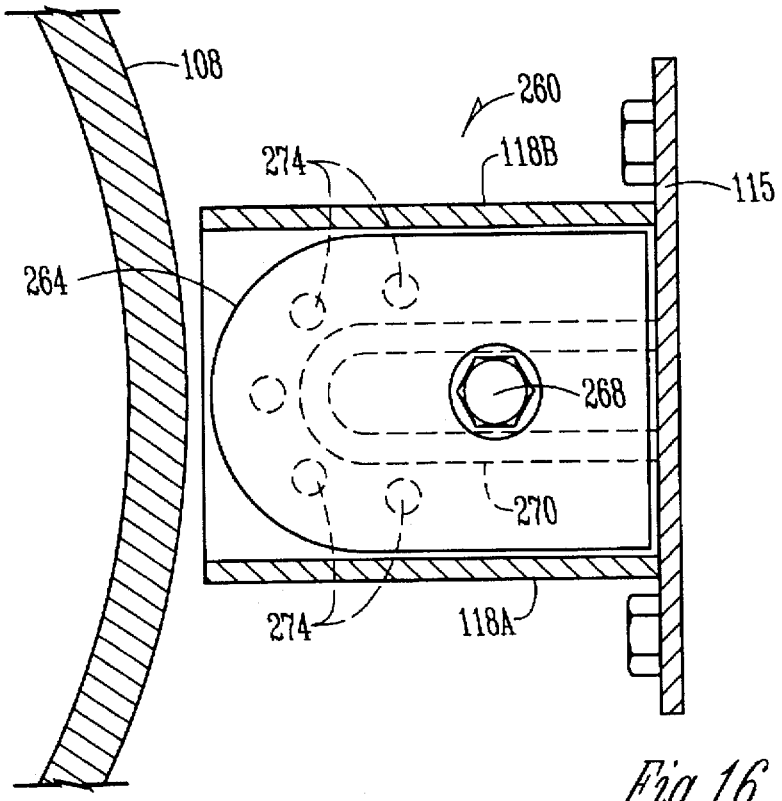
FIG. 16 is a plan view of the pivot/spring mechanism of FIGS. 14–15.

FIG. 13 illustrates a second configuration of annular roller latch mechanism 250, in which there are three ball plunger units arranged radially about the shaft of the spring-loaded bolt. This provides a more economical construction, albeit at some compromise of the stability of the latch mechanism, and it will be understood that other such mechanisms may accordingly be provide with fewer ball plunger units as desired e. Additional Embodiments FIGS. 14–16 illustrate an embodiment of the present invention in which the fulcrum joint is provided by an outwardly bevelled surface, in place of the bead-and-channel track which has been described above. Accordingly, FIG. 14 shows a spring-pivot mechanism 260 which is generally similar to that which has been described above with reference to FIGS. 3–10, in that there is a rim unit having an upper pivot plate 262 and a spacer block 264, which are biased downwardly toward a lower pivot plate 266 by a spring-load bolt 268. In this embodiment, however, the lower surface of the spacer block 264 is substantially planar, and the fulcrum point is provided by the U-shaped pivot block 270 having a continuous, outwardly and downwardly bevelled surface 272. The lower surface of the pivot block is substantially planar and rests on top of the flat upper surface of the lower pivot plate 266. Also, a plurality of vertically extending coil spring units are arranged between the lower pivot plate and the upper spacer block, in the border area along the perimeter of the pivot block 270 (see also FIG. 16).

The response of the spring-pivot unit 260 to a downward impact received on the rim is shown in FIG. 15. As can be seen, the planar lower surface of the spacer block 264 in essence tilts or rocks outwardly on the bevelled upper surface 272 towards the direction of the impact force. As this is done, the spring unit(s) **274*a* on this side are compressed between the spacer block and the lower pivot plate, thereby offering increasing resistance to the motion in this direction, while the spring unit(s) 274*b*** on the opposite side extend to accommodate the rocking motion.

Figure 17:
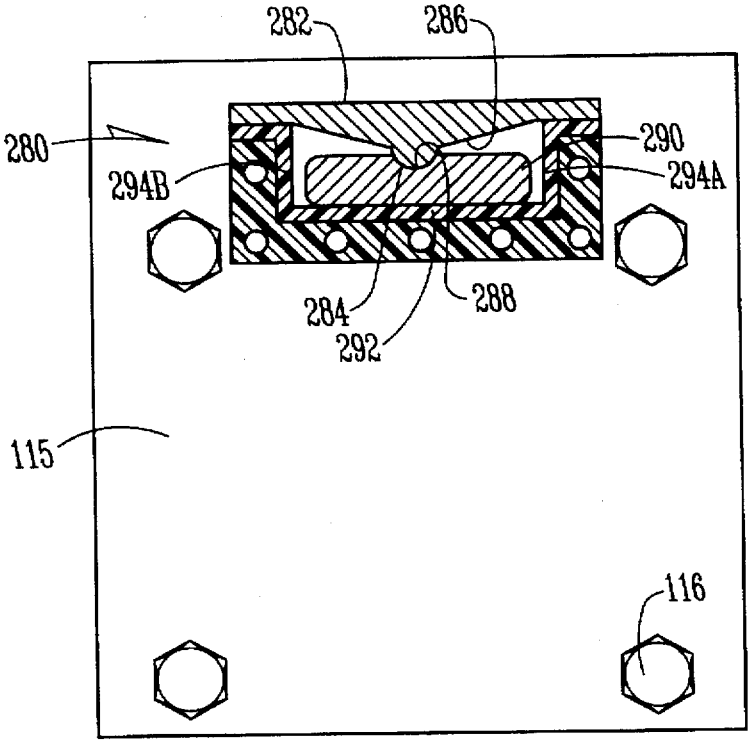
FIG. 17 is an end view similar to FIG. 14, showing an embodiment of the present invention in which the pivot/spring mechanism is provided by a pair of plate members having a central, 360° pivot point, and a U-shaped perimeter cup formed of an elastomeric material while providing the spring action.
Figure 18:
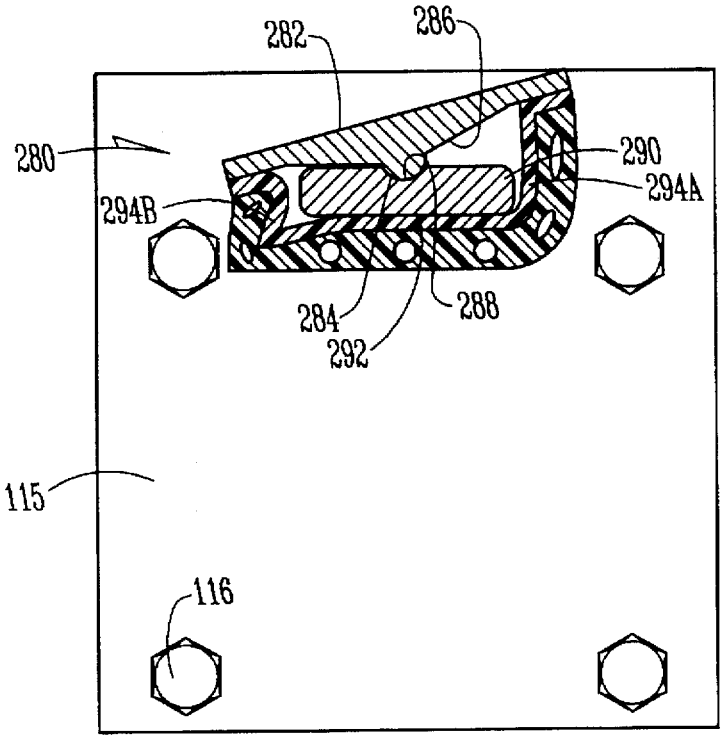
FIG. 18 is an end view similar to FIG. 17, illustrating the response of the mechanism to a downward impact force on a side portion of the hoop member.
Figure 19:
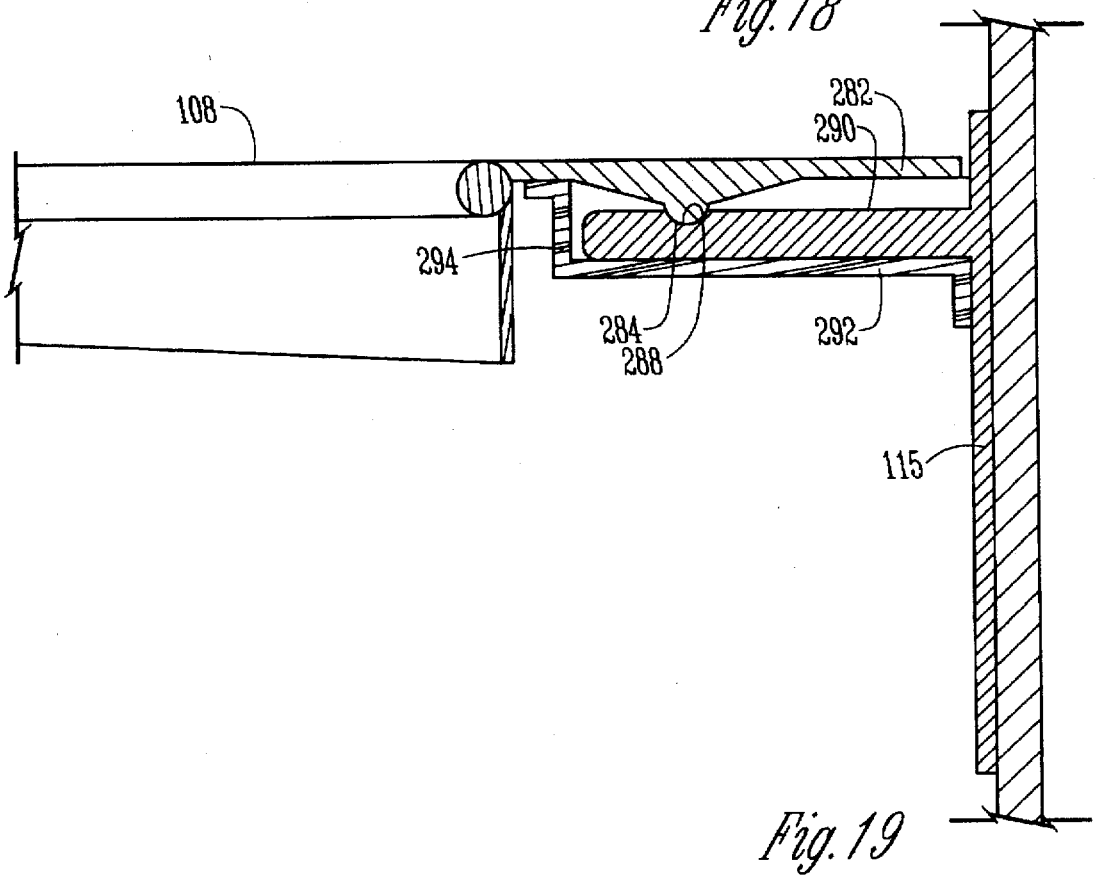
FIG. 19 is a side, cross-sectional view, similar to FIG. 5, of the pivot spring mechanism of FIGS. 17–18.

FIGS. 17–19 show another embodiment of spring-pivot mechanism 280 in accordance with the present invention. As can be seen, in this embodiment the upper pivot plate 282 has a more or less centrally located, downwardly protruding hemispherical bearing point 284 surrounded by a downwardly extending conical surface 286. The bearing point 284 is received for pivoting movement in a corresponding hemispherical recess 288 formed in the upper surface of the lower pivot plate 290. Thus, the upper pivot plate 282 is free to pivot about the "ball and socket" joint which is formed by the bearing point 288 and socket 284, throughout the 180° frontal plane.

A resiliently compressible, preferably elastomeric, U-shaped cup member 292 is mounted across the bottom of the lower pivot plate and has upwardly extending sidewall portions 294 which are mounted to the underside of the upper pivot plate 282 (see also FIG. 19). Thus, as can be seen in FIG. 18, when the upper pivot plate 282 tilts in response to an impact load received at the rim member, the resiliently compressible wall portion **294*b* on that side compresses to offer yielding resistance to the motion while the opposite wall 294*a* extends, in a manner somewhat similar to the spring units 274 shown in FIGS. 14–16. At the limit of angular travel, the conical lower surface 286 of the upper pivot plate comes into facial abutment with the planar upper surface of the lower pivot plate 290** to prevent further tilting motion.

Figure 20:
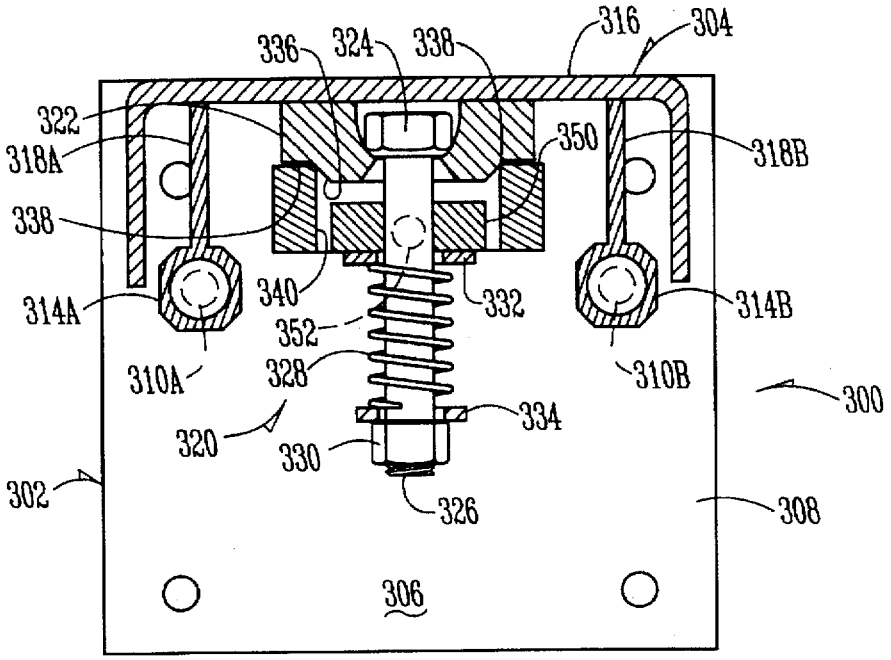
FIG. 20 is a front view, partially in vertical cross-section, of an embodiment of the present invention in which a positive latch mechanism of the pivot/spring mechanism is provided by spring plunger members which bear against the fixed mounting plate of the assembly.
Figure 21:
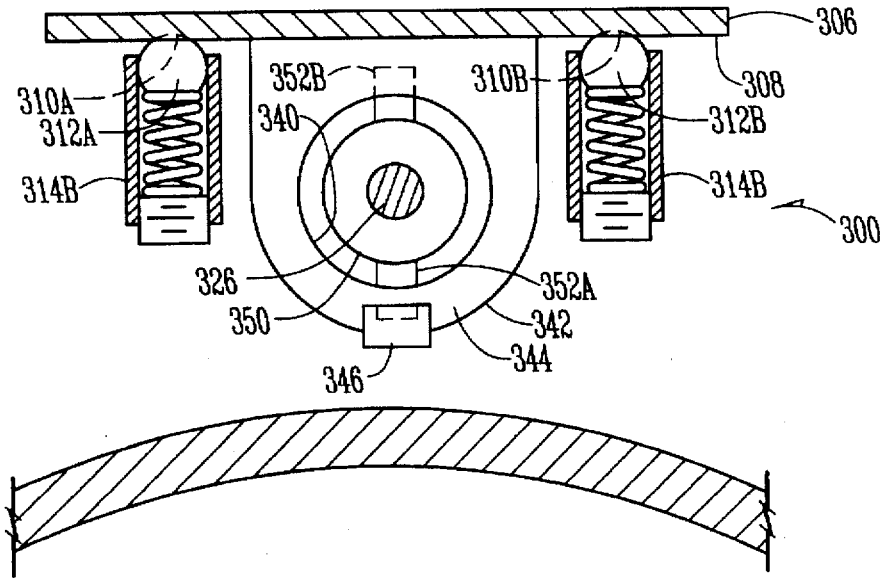
FIG. 21 is a top view, partially in cross-section, of the pivot/spring mechanism of FIG. 21.

FIGS. 20–21 show an embodiment of the present invention in which the positive latch mechanism is provided by spring plunger members which bear against the mounting plate of the assembly, as opposed to against a reaction bolt as shown in FIGS. 11–13. As can be seen, the spring-pivot mechanism 300 comprises a mounting unit 302 for attachment to a backboard, and a pivoting rim unit 304, similar to the embodiments which have been described above. The mounting unit is provided with a baseplate 306, and the front surface 308 of this is provided with first and second hemispherical recesses or "dimples" 310*a*, 310*b* (see also FIG. 21) which are positioned approximately level with one another and spaced apart towards opposite edges of the baseplate. The recesses 310*a*, 310*b* serve as detentes for receiving the ball members 312*a*, 312*b* of first and second spring plunger units 314*a*, 314*b*, which are similar in construction to the spring plunger units described above, but which bear rearwardly against the front surface 308 the baseplate so that the ball members 312 are yieldingly biased into the recesses 310.

The two spring plunger units 314*a*, 314*b* are attached to the top plate 316 of the pivoting rim unit 304 by downwardly extending flanges, and therefore move with the rim unit when this is displaced by an impact load. The recess/spring plunger detente mechanisms therefore serve in a manner analogous to the positive latch mechanism which is shown in FIGS. 11–13, to provide positive positioning of the rim unit in the horizontal position, until a predetermined minimum downward force is received by the hoop portion of the unit.

The pivot portion 320 of the mechanism is similar to that described above, in that there is a hemispherically dished cup member 322 which retains the head 324 of the reaction bolt 326, the lower end of the bolt being provided with a coil spring 328, nut 330 and washers 332, 334, in essentially the same manner as described above.

The cup member 33 is fixedly mounted to the top plate 316 of the pivoting rim unit, and is provided with a bevelled inner edge 336 which is surrounded by a flat shoulder 338. When the rim unit is in the unloaded, horizontal orientation, the bevelled edge 336 of the cup member 322 is received in a circular seat 340 formed in a stationary support bracket 342 which extends from the baseplate 306, and the flat shoulder on the bottom of the cup member rests in facial abutment against the flat upper surface 344 of the support plate. Also, in this position a rectangular key 346 on the bottom of the cup member engages a corresponding slot formed in the upper surface of the support bracket so as insure proper alignment of the hoop.

In response to a downward impact on the hoop which exceeds a predetermined minimum load, the two spring plunger units 314*a*, 14*b* move out of engagement with their retaining recesses 310*a*, 310*b*, and the rim unit tilts downwardly and forwardly about the pivot provided by the interface between the surfaces of the cup member and support bracket, pulling the reaction bolt upwardly so as to compress the reaction spring 330. Side-to-side tilting motion of the rim unit is facilitated by a yoke member 350 having a central bore through which the shaft of the bolt 326 extends in cooperating engagement. As can be best seen in FIG. 21, the yoke 350 is a circular or doughnut-shaped member which is supported for pivoting movement in support bracket 342 by forwardly and rearwardly extending axles 352*a*, 352*b*. Hence, the reaction load bolt 326 is free to slide up and down through the bore of the yoke member, while side to side pivoting motion is provided around the axis of axle members 352.

Figure 22:
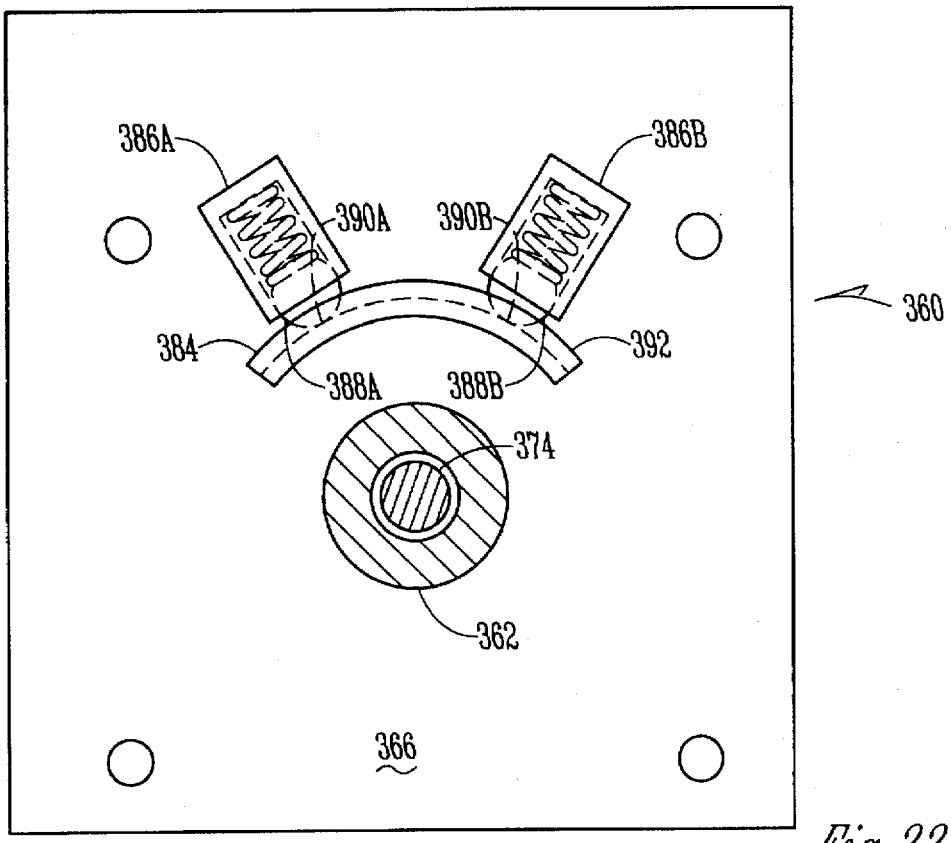
FIG. 22 is a front view, partially in cross-section, of an embodiment of the present invention in which the positive latch detente mechanism of the spring/pivot mechanism is provided by a pair of spring plunger units which bear against an arcuate plate member having indentations formed in the upper surface thereof.
Figure 23:
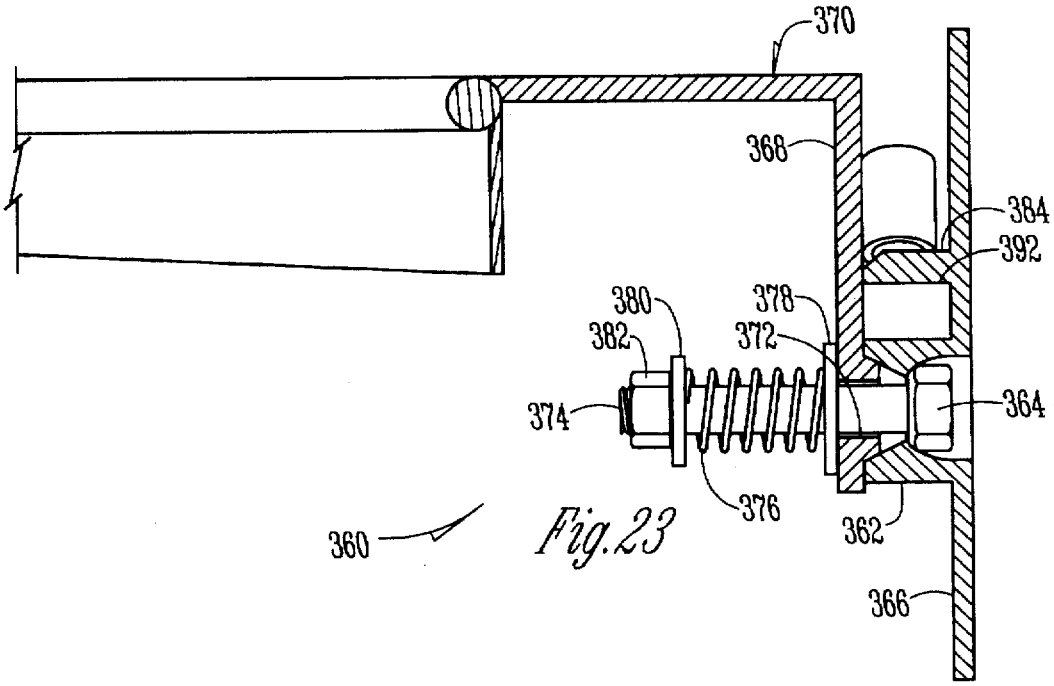
FIG. 23 is a side view, partially in cross-section of the pivot/spring mechanism of FIG. 22.

FIGS. 22–23 illustrate an embodiment in which the operation somewhat resembles that which is shown in FIGS. 20–21, except that the axis of the reaction load bolt extends horizontally instead of in a vertical direction. Accordingly, as can best be seen in FIG. 23, the cup 362 for retaining the head 364 of the reaction load bolt is formed directly on the baseplate 366 and projects forwardly therefrom, with the axis of its bore extending in a horizontal direction. A vertically extending plate member 368 of the pivoting rim unit 370 abuts the outer edge of the cup member, and is provided with a bore 372 through which the shaft of the reaction load bolt 374 passes in a horizontal direction. In a manner similar to the embodiments described above, the cup member 362 and plate member 368 are held in yielding abutment by a compression spring 376, washers 378, 380, and nut 382.

The stationary portion of the positive latch detente mechanism is provided by an arcuate plate 384 which is welded to and extends perpendicularly from the front surface of the baseplate 366, and which extends along an arc of constant radius from the reaction bolt and cup structure 362. The spring plunger units 386*a*, 386*b*, in turn, are welded to the back of the vertically-extending plate member 368 of the pivoting rim unit, in the gap between this and the stationary baseplate 366. The spring plunger units 386*a*, 386*b* are arranged radially relative to the axis of the reaction bolt assembly, and perpendicularly to the stationary arcuate plate 384 so that the ball members 388*a*, 388*b* thereof are yieldingly biased into engagement with the upper surface of the arcuate plate. In a manner similar to that described above, first and second hemispherical recesses 390*a*, 390*b* are formed in the upper surface of arcuate plate 384 for receiving the ball members when the rim unit is in its initial, horizontal orientation. In response to a downward impact which exceeds a predetermined minimum load, however, the ball members of the spring plunger units 386*a*, 386*b* disengage from their retaining recesses. To accommodate side-to-side motion, the ball members roll along the curved upper surface of the arcuate plate 384, and for forward tilting motions they ride over the bevelled outer edge 392 of the plate. Upon release, the spring loaded reaction bolt biases plate 368 back to its vertical orientation, and thus returns the hoop portion of the rim unit to its horizontal alignment.

Figure 24:
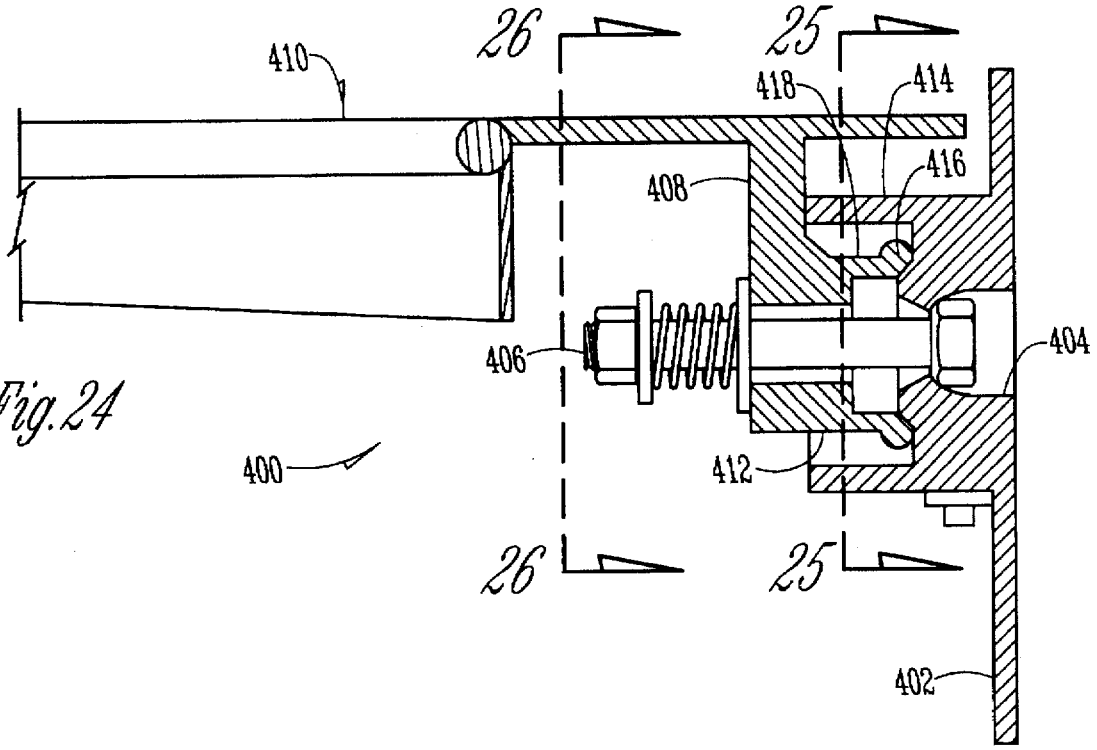
FIG. 24 is a side view, partially in cross-section, of an embodiment of the present invention in which the spring-pivot mechanism incorporates a spring loaded reaction bolt which is somewhat similar to that which is shown in FIGS. 5–6, but in which the shaft of the bolt extends in a horizontal direction, and there are spring loaded stops to limit pivoting motion of the rim in the side-to-side direction.
Figure 25:
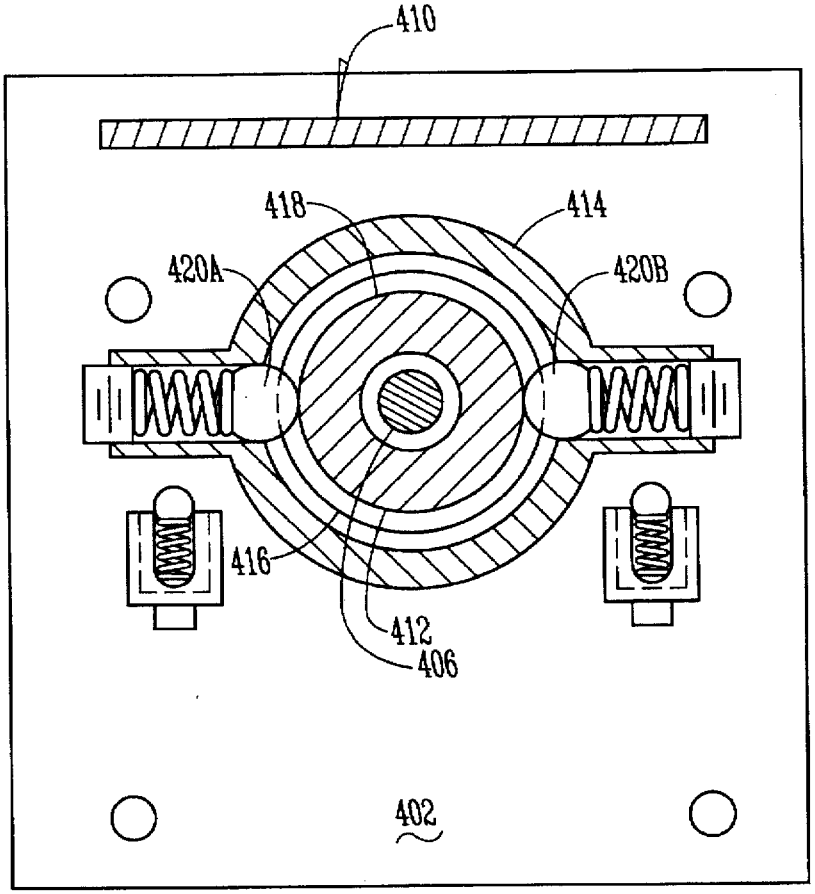
FIG. 25 is an end view of a cross-section taken vertically through the spring-pivot mechanism of FIG. 24, along line 25—25.
Figure 26:
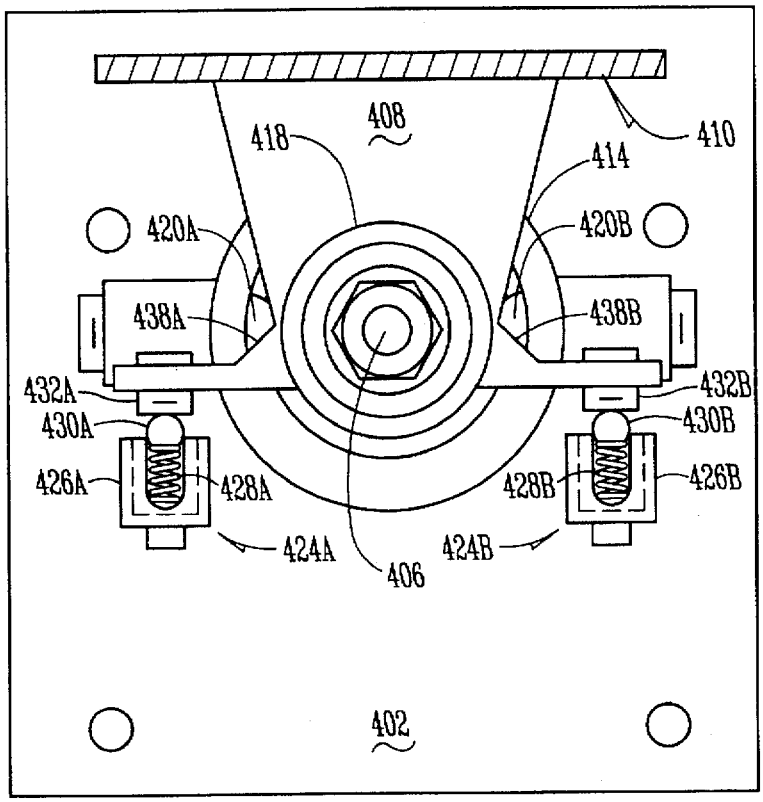
FIG. 26 is an end view of a vertical cross-section of the spring-pivot mechanism of FIG. 24, taken along line 26—26.

FIGS. 24–26 illustrate another spring-pivot mechanism 400 in which the axis of the reaction load bolt assembly extends in a generally horizontal direction, but which differs from that which is shown in FIGS. 22–23 in several respects. As before, there is a baseplate 402 having a retaining cup 404 through which the reaction load bolt 406 extends in a horizontal direction so as to bias a plate member 408 of the pivoting rim unit 410 into a vertical orientation. In the embodiment which is illustrated in FIGS. 24–26, however, a cylindrical hub member 412 is mounted on the rearward surface of the movable plate 408, and extends into a cylindrical receptacle 414 which is formed annularly about and extends forwardly from the retaining cup structure 404. A circumferential shoulder 416 on the end of the hub member 412 defines an annular channel 418. As can best be seen in FIG. 25, the annular channel 418 receives the inwardly biased ball members 420*a*, 420*b* of spring plunger units 422*a*, 422*b*, which are mounted to and penetrate the wall of the receptacle 414 on generally opposite sides thereof.

Thus, in response to downward loads in a forward direction, the ball members of the spring plunger units ride up the shoulder 416 as the hub member 412 is withdrawn from socket 414, providing a detente action similar to that described above with reference to FIGS. 11–13. Engagement of the two ball members with the annular channel 418, in permits side-to-side rotational movement of the pivoting rim unit, generally about the axis of the reaction Load bolt. Pivoting motion in this direction is limited by adjustable stop mechanisms 424*a*, 424*b*. As can be seen in FIG. 26, these each comprise a spring plunger unit 426*a*, 426*b* which is fixedly mounted to the stationary baseplate 402. Each spring plunger unit 426*a*, 426*b* is provided with a housing which encloses a coil spring 428*a*, 428*b* which biases the ball member 430*a*, 430*b* upwardly from an open upper end of the housing. The protruding ball members engage stop members 432*a*, 432*b* which are mounted on extensions 434*a*, 434*b* of the pivoting plate member 408. Preferably, the stop members 432*a*, 432*b* are in threaded engagement with the extensions 438 so as to permit adjustment against the protruding ball members, so as to be able to adjust the resistance which is offered thereby and also allow the hoop portion of the unit to be leveled in preparation for use. Accordingly, in response to a side-to-side component of the pivoting motion, the moving stop member 432 on that side will depress the corresponding spring plunger unit, so that gradual increasing resistance is offered thereby and the motion is ultimately limited to within the design range.

Figure 27:
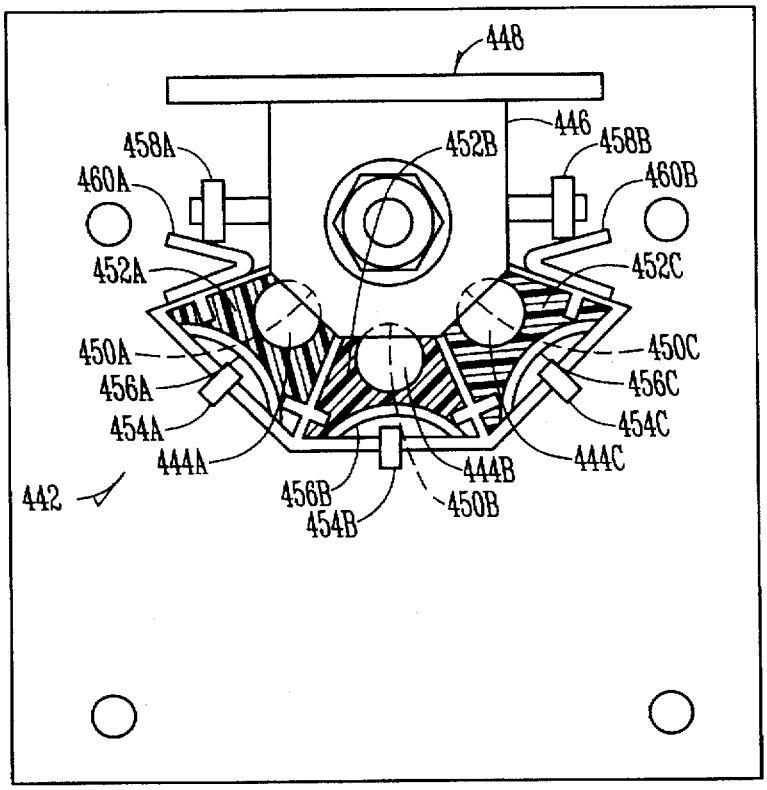
FIG. 27 is a forward end view of an embodiment of the present invention in which the spring-pivot mechanism also has a horizontally extending reaction load axis, and in which the detente mechanism is provided by a series of ball members which are biased into yielding engagement with recesses formed in the underside of the pivoting rim unit.

FIG. 27 shows another spring-pivot mechanism 440 having a horizontally extending reaction load axis. In overall configuration, this somewhat resembles the embodiment which is shown in FIGS. 24–26. The detente mechanism 442, however, is provided by a series of ball members 444*a–c* which are arranged in a generally radial array beneath a pivot block 446 which forms a part of the pivoting rim unit 448, and which engage recesses 450*a–c* which are formed in the lower side of the pivot block. The ball members 444 are retained in elastomeric elements 452*a–c*, and the force with which these are biased into engagement with the recesses in the pivot block is selectively adjustable by means of threaded adjustment screws which bear inwardly against deflectable metal backing plates 456*a–c*. Thus, in response to a predetermined downward impact load being received by the rim unit, the ball units are displaced from their respective recesses so as to permit pivoting movement of the rim unit, in a manner similar to that described above. Side-to-side pivot motion is limited by lateral stops 458*a*, 458*b* which compress first and second V-shaped leaf spring elements 460*a*, 460*b* against the adjacent elastomeric block units.

Figure 28:
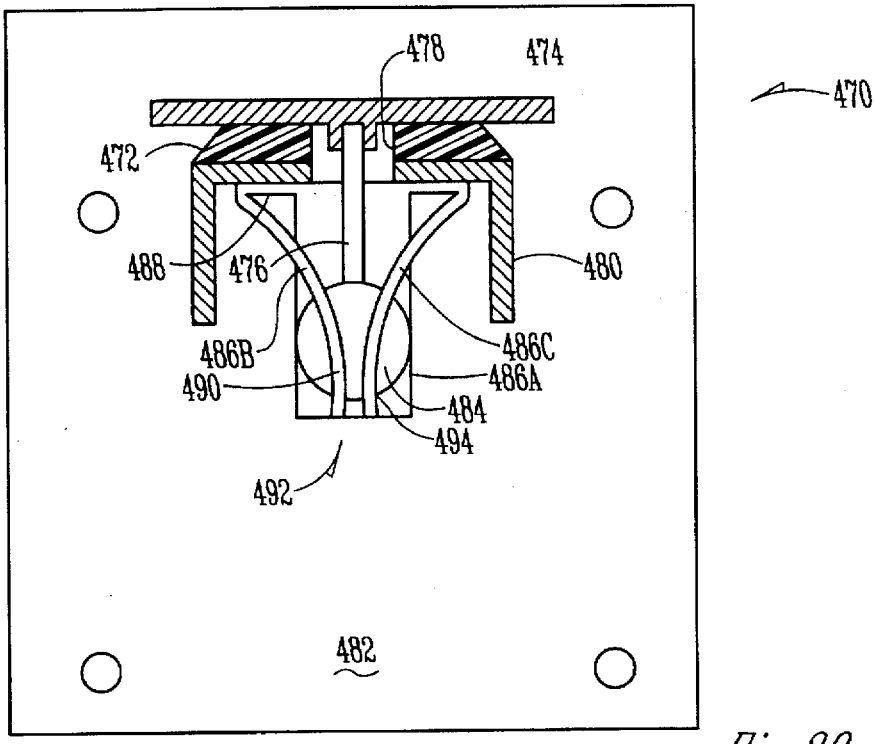
FIG. 28 is a forward end view, partially in cross-section, of an embodiment of the present invention in which the reaction load of the spring-pivot mechanism is provided by a depending ball member which is positioned in engagement with the nested lower ends of downwardly curved leaf springs.
Figure 29:
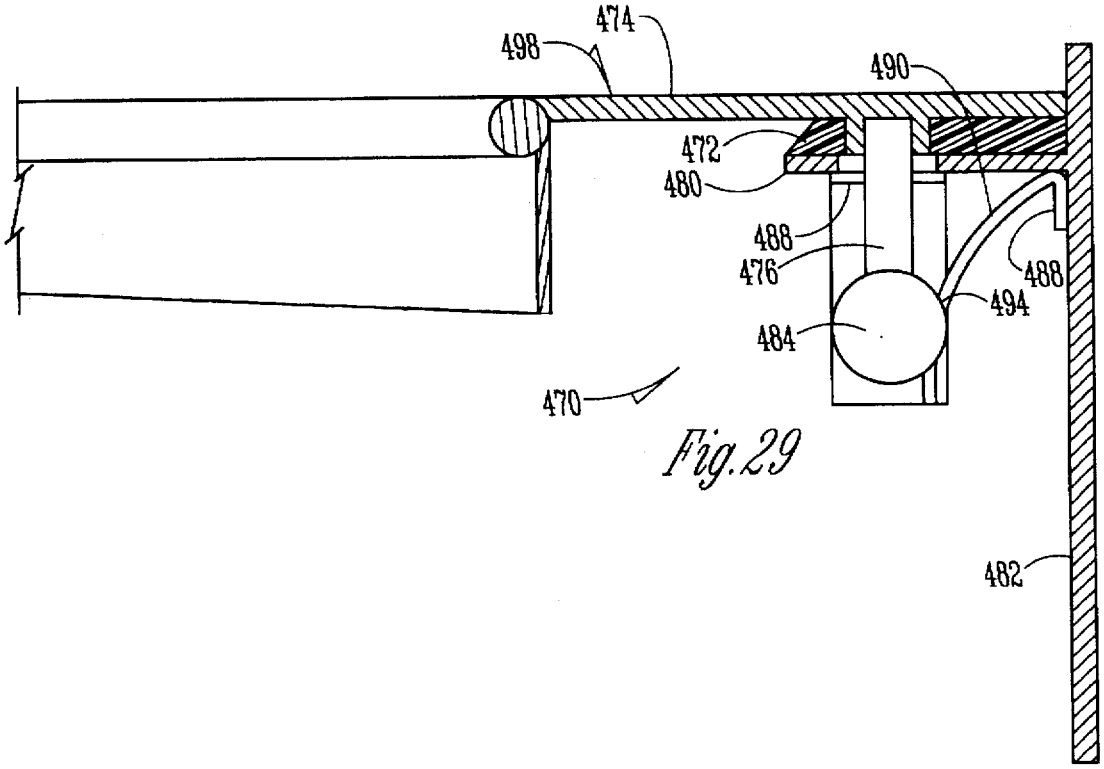
FIG. 29 is a side view, partially in cross-section of the spring-pivot mechanism of FIG. 28.

FIGS. 28–29 show an embodiment of the present invention having a spring-pivot mechanism 470 which somewhat resembles that shown in FIGS. 14–16, in that a bevelled pivot block 472 provides the U-shaped fulcrum joint, but in which the reaction load is provided by a deflectable leaf spring assembly, as opposed to the coil spring/bolt assemblies described above.

Accordingly, as can be seen in FIGS. 28 and 29, the upper pivot plate 474 is provided with a downwardly extending strut 476 which passes through an opening 478 formed in the pivot block and the underlying fixed support bracket 480 which extends from baseplate 482. A relatively large ball member 484 is mounted at the lower end of the strut 476, and is received in engagement with the nested lower ends of a plurality of downwardly extending leaf springs 486*a–c*. Each of the leaf springs 486 is provided with an angular mounting flange 488 at its upper end which is mounted to the fixed support plate 480 and/or baseplate 482, and a downwardly curved leaf portion 490. The leaf portions 490 converge towards their lower ends to form a receiving area 492 for the ball member 484, and the lower end of each leaf portion is provided with an opening 494 which receives a side of the ball member 484, with the flexible leaf portion being forced somewhat outwardly thereby.

Thus, as can be seen, the ball member 484 is received in engagement with the nested lower ends of the three leaf springs 486*a–c*, with the leaf portions thereof being forced somewhat outwardly so as to provide a degree of preload. Then, as the pivoting rim unit 498 tilts on the pivot block 472 in response to a downward impact load, the ball member 44 on the end of depending strut 476 swings in a direction generally away from the load, compressing the leaf spring which is in engagement with that side of the ball member. The leaf spring thus provides a resistance to the pivoting motion of the rim unit, which increases with increasing displacement of the rim and then serves to bias the rim unit back to its horizontal orientation once the load is released.

It is to be recognized that various alterations, modifications, and/or additions may be introduced into the constructions and arrangements of parts described above without departing from the spirit or ambit of the present invention as defined by the appended claims.

Having now described my invention, what I claim as new and desire to secure by Letters Patent is:

1. A breakaway basketball rim assembly comprising:

(a) a stationary base member for mounting to a vertically extending backboard;

(b) a releasable rim member having a circular hoop portion which extends in a generally horizontal plane; and (c) a release assembly operably interconnecting said base member and said rim member, said release assembly comprising:

means for releasing said rim member in response to a downward load received at any point along an extended frontal arc of said circular hoop portion, so that said hoop portion tilts independently of said backboard and said stationary base member and downwardly from said horizontal plane generally in the direction of said point at which said load is received, so as to avoid transmission of significant shock and torsional loads to said backboard; and means for returning said circular hoop portion of said rim member to said generally horizontal plane following release of said downward load from said hoop portion.

2. The basketball rim assembly of claim 1, wherein said means for releasing said rim member comprises:

pivot means for permitting said rim member to pivot downwardly relative to said stationary base member in said direction toward said point anywhere along said frontal arc at which said downward load is received.

3. The basketball rim assembly of claim 2, wherein said means for returning said hoop portion of said rim member to said horizontal plane comprises:

resilient reaction load means connected to said rim member and said stationary base member so that said reaction load means yieldingly biases said rim member towards an initial playing position in which said hoop portion extends in said generally horizontal plane.

4. The basketball rim assembly of claim 3, wherein laid pivot means comprises:

a pivot structure for providing a pivot point between said rim member and said stationary base member substantially in direct alignment between said point anywhere along said frontal arc at which said downward load is received and a reaction point at which said reaction load means acts upon said rim member to return said hoop portion to said horizontal plane.

5. The basketball rim assembly of claim 4, wherein said pivot structure forms a first lever arm from said point on said hoop portion at which said downward load is received to said pivot point, and a second lever arm from said pivot point to said reaction point, said first and second lever arms defining a ratio which is substantially identical for all points along said extended frontal arc of said hoop portion, so that said rim member is released in response to a substantially identical minimum downward load received at any point along said frontal arc.

6. The basketball rim assembly of claim 1, wherein said means for releasing said rim member comprises:

means for releasing said rim member in response to a substantially identical minimum downward load received at any point along said extended frontal arc of said hoop portion.

7. A breakaway basketball rim assembly comprising:

(a) a stationary base member for mounting to a vertically extending backboard;

(b) a releasable rim member having a circular hoop portion which extends in a generally horizontal plane; and (c) a release assembly operably interconnecting said base member and said rim member, said release assembly comprising:

a pivot structure for permitting said rim member to pivot downwardly from said horizontal plane relative to said stationary base member in response to a downward load received at any point along an extended frontal arc of said circular hoop portion; and a resilient reaction load means connected to said rim member and said stationary base member so that said reaction load means biases said rim member to said generally horizontal plane following release of said downward load from said hoop portion;

said pivot structure providing a pivot point between said rim member and said stationary base member substantially in direct alignment between said point anywhere along said frontal arc at which said downward load is received and a reaction point at which said reaction load means acts upon said rim member to return said hoop portion to said horizontal plane.

8. The basketball rim assembly of claim 7, wherein said extended frontal arc is an approximately 180° frontal arc of said circular hoop portion.

9. The basketball rim assembly of claim 8, wherein said pivot structure comprises:

fulcrum means having an elongate, substantially semi-circular forward portion disposed intermediate said reaction point and said hoop portion and having a curvature which generally corresponds to that of said 180° frontal arc of said hoop portion, so that said semi-circular portion of said fulcrum means provides a fulcrum point located between said downward load and said reaction load for any point along said 180° frontal arc of said hoop portion of said rim member.

10. The basketball rim assembly of claim 9, wherein said reaction point lies within an arc which is described by said semi-circular forward portion of said fulcrum means.

11. The basketball rim assembly of claim 10, wherein said fulcrum means comprises:

an elongate bead member having a protruding, generally semi-circularly rounded edge along said forward portion of said fulcrum means; and an elongate channel member having a generally semi-circularly dished groove along said forward portion of said fulcrum means;

said edge of said bead member being received in said groove of said channel member when said rim member is in said initial playing position so as to form a fulcrum joint which extends in a generally horizontal plane.

12. The basketball rim assembly of claim 11, wherein said pivot structure further comprises:

a generally horizontal lower pivot plate portion of said stationary base member, said lower pivot plate portion having said channel member formed in an upper surface thereof; and an upper pivot plate portion of said rim member which extends rearwardly from and generally parallel to said hoop portion, said upper pivot plate portion having said bead member formed on a lower surface thereof;

so that said upper and lower pivot plate portions extend generally parallel to one another in face-to-face juxtaposition when said rim member is in said initial playing position.

13. The basketball rim assembly of claim 12, wherein said resilient reaction load means comprises:

means for yieldingly biasing said upper and lower pivot plate portions towards one another into said parallel, face-to-face juxtaposition.

14. The basketball rim assembly of claim 13, wherein said reaction load means comprises:

compression spring means mounted to portions of said upper and lower pivot plate portions rearwardly of said curved forward portion of said fulcrum joint, so that said compression spring means is compressed as said portions of said pivot plate portions rearward of said fulcrum joint move apart as said rim member tilts downwardly in said direction of said point forward of said fulcrum joint at which said downward load is received by said hoop portion.

15. The basketball rim assembly of claim 14, wherein said compression spring means comprises a coil spring.

16. The basketball rim assembly of claim 15, wherein said reaction load means comprises:

a shaft member having an upper end which is retained in said upper pivot plate portion and a lower end which extends through a bore in said lower pivot plate portion;

a coil compression spring mounted around said lower end of said shaft member below said lower plate portion; and a retainer mounted on said shaft member below said coil spring so that said spring is compressed between said retainer and a lower surface of said lower pivot plate portion as said rearward portions of said pivot plate portions move apart.

17. The basketball rim assembly of claim 10, wherein said fulcrum means comprises:

a first pivot member having a substantially planar engagement surface; and a second pivot member having an outwardly bevelled border extending along a substantially semi-circular path around a generally planar engagement surface, intermediate said reaction point and said hoop portion;

said first and second pivot members being arranged in face-to-face abutment when said rim member is in said initial playing position, so that in response to a downward load said engagement surface of said first pivot member pivots from said engagement surface of said second pivot member onto said bevelled border thereof so as to tilt said hoop portion of said rim member towards said point at which said downward load is received.

18. The basketball rim assembly of claim 10, wherein said semi-circular forward portion of said fulcrum means is configured so that each said fulcrum point which is provided thereby forms a first lever arm from said point on said hoop portion at which said downward load is received to said fulcrum point and a second lever arm from said fulcrum point to said reaction point, said first and second lever arms defining a ratio which is substantially identical for all points along said 180° frontal arc of said hoop portion, so that said rim member is released in response to a substantially identical minimum downward load received at any point along said 180° frontal arc.

19. The basketball rim assembly of claim 13, wherein said fulcrum means further comprises:

first and second substantially parallel straight-line sections of said bead and channel members extending rearwardly from said semi-circular forward portion of said fulcrum means for stabilizing said pivot structure and said hoop portion against side-to-side motions in said horizontal plane.

20. A breakaway basketball rim assembly comprising:

(a) a stationary base member for mounting to a vertically extending backboard;

(b) a releasable rim member having a circular hoop portion which extends in a generally horizontal plane; and (c) a release assembly operably interconnecting said base member and said rim member, said release assembly comprising:

means for releasing said rim member in response to a substantially identical minimum downward load received at any point along an extended frontal arc of said hoop portion, so that said hoop portion tilts downwardly from said horizontal plane generally in the direction of said point at which said load is received; and means for returning said rim member to said generally horizontal plane following release of said downward load from said hoop portion.

* * * * *